US007903068B2

(12) United States Patent
Chen et al.

(10) Patent No.: US 7,903,068 B2
(45) Date of Patent: Mar. 8, 2011

(54) LIQUID CRYSTAL DISPLAY AND DRIVING METHOD THEREOF

(75) Inventors: Po-Yang Chen, Tao-Yuan Hsien (TW); Po-Sheng Shih, Tao-Yuan Hsien (TW)

(73) Assignee: HannStar Display Corporation, Tao-Yuan Hsien (TW)

( * ) Notice: Subject to any disclaimer, the term of this patent is extended or adjusted under 35 U.S.C. 154(b) by 1115 days.

(21) Appl. No.: 11/527,463

(22) Filed: Sep. 27, 2006

(65) Prior Publication Data

US 2008/0007506 A1 Jan. 10, 2008

(30) Foreign Application Priority Data

Jul. 4, 2006 (TW) ..... 95124379 A

(51) Int. Cl.
*G09G 3/36* (2006.01)

(52) U.S. Cl. ..... 345/95

(58) Field of Classification Search ..... 345/87–104; 349/48; 348/48
See application file for complete search history.

(56) References Cited

U.S. PATENT DOCUMENTS

| | | | | |
|---|---|---|---|---|
| 6,246,385 | B1 * | 6/2001 | Kinoshita et al. | 345/87 |
| 7,109,958 | B1 * | 9/2006 | Martin | 345/87 |
| 2003/0189559 | A1 * | 10/2003 | Lee et al. | 345/204 |
| 2003/0227429 | A1 * | 12/2003 | Shimoshikiryo | 345/90 |
| 2004/0119704 | A1 * | 6/2004 | Miyajima et al. | 345/204 |

* cited by examiner

*Primary Examiner* — Amr Awad
*Assistant Examiner* — Aaron Midkiff
(74) *Attorney, Agent, or Firm* — Muncy, Geissler, Olds & Lowe, PLLC

(57) ABSTRACT

The present invention provides a liquid crystal display including a plurality of pixel units defined by scanning lines and data lines. Each pixel unit includes two sub-pixels. Each sub-pixel includes a storage capacitor. The two storage capacitors in a pixel unit are connected to different voltage sources to modify the electric potential of the pixel electrodes.

3 Claims, 13 Drawing Sheets

LIQUID CRYSTAL DISPLAY AND DRIVING METHOD THEREOF

RELATED APPLICATIONS

The present application is based on, and claims priority from, Taiwan Application Serial Number 95124379, filed Jul. 4, 2006, the disclosure of which is hereby incorporated by reference herein in its entirety.

FIELD OF THE INVENTION

The present invention relates to a Liquid crystal display, and more particularly to a liquid crystal display with improved view angle.

BACKGROUND OF THE INVENTION

Liquid crystal displays have been used in various electronic devices. A Vertically Aligned Mode (VA mode) liquid crystal display is developed to provide a wider viewing range. In the VA mode, when a user looks at this LCD from the oblique direction, the skin color of Asian people (light orange or pink) appears bluish or whitish. Such a phenomenon is called color wash-out.

The transmittance-voltage (T-V) characteristic of the VA mode liquid crystal display is shown in FIG. 1A and FIG. 1B. The vertical axis is the transmittance rate. The horizontal axis is the applied voltage. When the applied voltage is increased, the transmittance rate curve 102 in the normal direction is also increased. The transmittance changes monotonically as the applied voltage increases. However, in the oblique direction, the transmittance rate curve 104 winds and the various gray scales become the same. This is the main reason to cause the color wash-out.

A method, called Half-tone technology developed by H. Yoshida et al. (Fujitsu Display Technologies Corporation), is provided to improve the foregoing problem. This method combines two different T-V characteristics in one pixel. FIG. 1B illustrates the Half-tone technology. The line 106 in FIG. 1B shows the T-V characteristics with a lower threshold voltage. The line 108 in FIG. 1B shows the T-V characteristics with a higher threshold voltage. By optimizing the threshold voltage and combining transmittance of these two lines, monotonic characteristics can be realized, as shown by the line 110 in FIG. 1B.

There are two types of Half-tone technologies, CC type and TT type. FIG. 2A illustrates the CC type Half-Tone technology. FIG. 2B illustrates the TT type Half-tone technology. According to the two types of Half-tone technologies, a pixel unit is divided into two sub pixels, the first sub-pixel and the second sub-pixel. Different Gamma curves are generated by the first sub-pixel and the second sub-pixel respectively. There, the color shift phenomenon is removed by mixing the two Gamma curves. FIG. 2C illustrates the Gamma curve of a CC type and FIG. 2D illustrates the Gamma curve of a TT type. For example, in FIG. 2C, according to a special applied voltage, the Gamma curve of the first sub-pixel and the Gamma curve of the second sub-pixel are mixed to form the Gamma curve of the pixel unit.

In FIG. 2A, a pixel unit is divided into two regions. A voltage divider composed of two capacitors 214 and 210 is used to form two Gamma curves of two sub-pixel electrodes 206 and 212 respectively. A data voltage in the data line is transferred to the sub-pixel electrode 206 through the transistor 202 to form the electric potential thereon. On the other hand, the electrical potential of the sub-pixel electrode is determined by the data line through capacitor 210. That is, the sub-pixel electrode 212 is in a floating state. Its electric potential is determined by a coupling effect. Charge is trapped into the sub-pixel electrode 212 to shift the electric potential thereon. That affects the quality of a panel.

In FIG. 2B, a pixel unit is divided into two regions. Two thin film transistors 218 and 220 and two capacitors are arranged in the two regions respectively. Two scanning lines or two data lines are used to drive transistors 218 and 220 respectively to form two different Gamma curves to improve the display image quality. However, such structure requires two scanning lines or two data lines to drive a pixel unit, which reduces the aperture ratio and complicates the circuit.

Therefore, a pixel unit and liquid crystal display driving method thereof is required to resolve the foregoing problems.

SUMMARY OF THE INVENTION

The main purpose of the present invention is to provide a liquid crystal display with a wide view angle that combines two different T-V characteristics to avoid the color shift phenomenon.

The purpose of the present invention is to provide a pixel unit with two different T-V characteristics to avoid the charge accumulation and the electrical potential shift phenomenon.

The purpose of the present invention is to provide a pixel unit to simplify the circuit and reduce power consumption.

Accordingly, the liquid crystal display comprises a plurality of parallel scanning lines and a plurality of parallel data lines that cross the scanning lines, wherein the adjacent first scanning line and data line define a pixel unit including a first sub-pixel and a second sub-pixel. Each sub-pixel includes a storage capacitor. The two storage capacitors are coupled to different voltage sources to modify the pixel electrodes to make the two pixel electrodes have different electric potentials. The different electric potentials generate different T-V characteristics. A monotonic T-V characteristic is generated by combing the different T-V characteristics.

According to another embodiment, a pixel unit of the present invention comprises: a first thin film transistor located in the first sub-pixel, wherein the first thin film transistor includes a first gate electrode, a first source electrode and a first drain electrode; and a second thin film transistor located in the second sub-pixel, wherein the second thin film transistor includes a second gate electrode, a second source electrode and a second drain electrode, wherein the first source electrode is coupled to a first voltage source, the second source electrode is coupled to a second voltage source, the first drain electrode is coupled to the data line, and the second drain electrode receives a voltage transferred in the data line.

According to an embodiment, the second drain electrode is coupled to the data line.

According to an embodiment, the second voltage source is from the second scanning line.

According to an embodiment, the first voltage source is from the second scanning line.

According to an embodiment, the second drain electrode is coupled to the first source electrode.

According to an embodiment, the second voltage source is from the second scanning line.

According to an embodiment, the first voltage source is from a common electrode line.

According to an embodiment, the first voltage source is from the second scanning line.

According to an embodiment, the first voltage source and second voltage source are the same voltage source.

According to another purpose of the present invention, the present invention provides a liquid crystal display driving method. The method comprises providing a high level electric potential to a first scanning line for writing a data signal transferred in a data line to a first sub-pixel electrode through a first thin film transistor and to a second sub-pixel electrode through a second thin film transistor; and to provide a low level electric potential to the first scanning line for isolating the first sub-pixel electrode and the second sub-pixel electrode from the data line. After the electric potential transition of the first scanning line between the high level electric potential and the low level electric potential, a coupling electric potential is generated to the first sub-pixel electrode and the second sub-pixel electrode, a second scanning line is adjacent to the first scanning line.

According to an embodiment, the liquid crystal display driving method is a three level liquid crystal display driving method including a first electric potential, a second electric potential and a third electric potential, wherein the first electric potential is larger than the second electric potential, and the second electric potential is larger than the third electric potential.

According to an embodiment, the high level electric potential is the first electric potential, the low level electric potential is the second electric potential, and the coupling electric potential is generated in the second scanning line transferred from the third electric potential to the second electric potential.

According to an embodiment, the high level electric potential is the first electric potential, the low level electric potential is the third electric potential, and the coupling electric potential is generated when the electric potential in the second scanning line when the second electric potential transited to the third electric potential.

According to an embodiment, the liquid crystal display driving method is a four liquid crystal display driving method including a first electric potential, a second electric potential, third electric potential and a fourth electric potential, wherein the first electric potential is larger than the second electric potential, the second electric potential is larger than the third electric potential, and the third electric potential is larger than the fourth electric potential.

According to an embodiment, the high level electric potential is the first electric potential, the low level electric potential is the second electric potential, and the coupling electric potential is generated in the second scanning line when the fourth electric potential transited to the third electric potential.

According to an embodiment, the high level electric potential is the first electric potential, the low level electric potential is the fourth electric potential, and the coupling electric potential is generated in the second scanning line when the second electric potential transited to the third electric potential.

According to an embodiment, the high level electric potential is the first electric potential, the low level electric potential is the third electric potential, and the coupling electric potential is generated in the second scanning line when the fourth electric potential transited to the third electric potential.

According to an embodiment, the high level electric potential is the first electric potential, the low level electric potential is the third electric potential, and the coupling electric potential is generated in the second scanning line when the second electric potential transited to the third electric potential.

Accordingly, a pixel unit in the present invention is divided into two sub-pixels. Each sub-pixel includes a thin film transistor, a liquid crystal capacitor and a storage capacitor. The two sub-pixels generate different pixel voltages to compensate for each other to release the color shift phenomenon.

BRIEF DESCRIPTION OF THE DRAWINGS

The foregoing aspects and many of the attendant advantages of this invention are more readily appreciated and better understood by referencing the following detailed description, when taken in conjunction with the accompanying drawings, wherein.

DETAILED DESCRIPTION OF THE PREFERRED EMBODIMENT

Figure 1A:
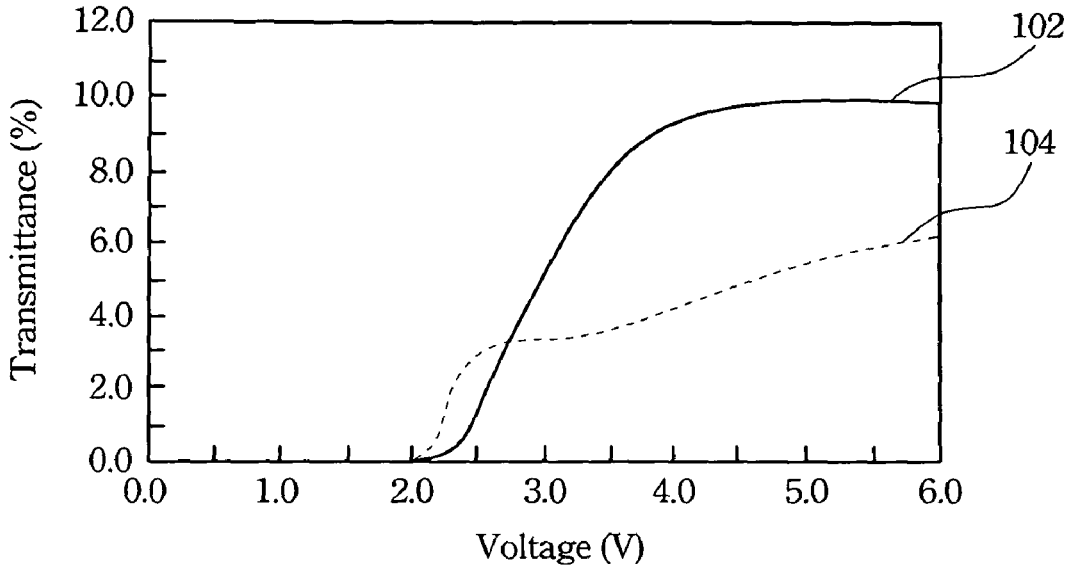
Fig. 1A (PRIOR ART)
FIG. 1A and FIG. 1B illustrate the transmittance-voltage (T-V) characteristic of VA mode liquid crystal display.
Figure 1B:
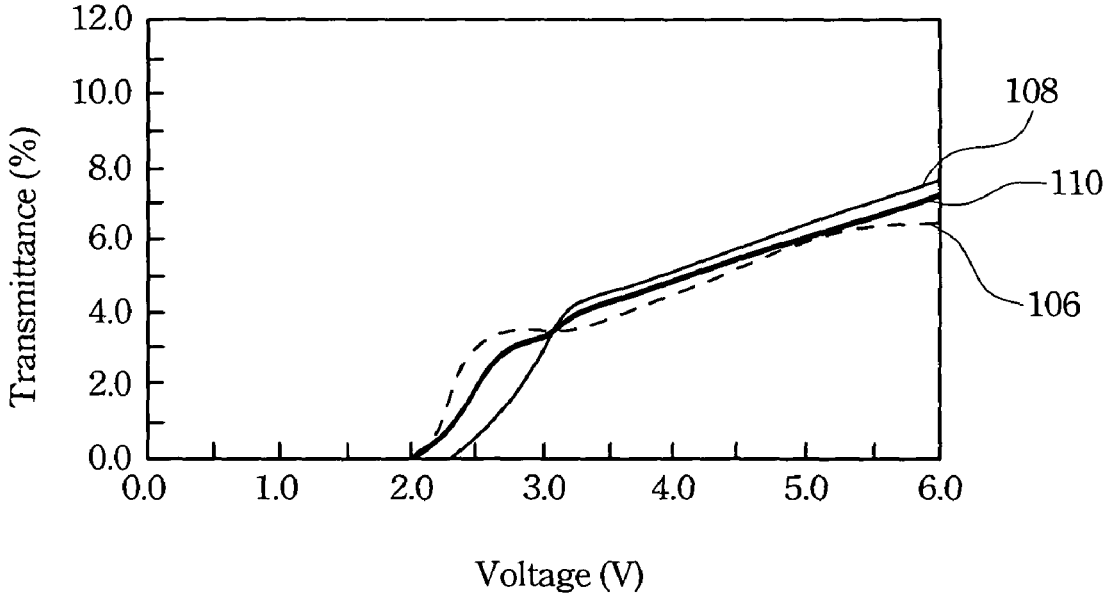
Fig. 1B (PRIOR ART)
Figure 2A:
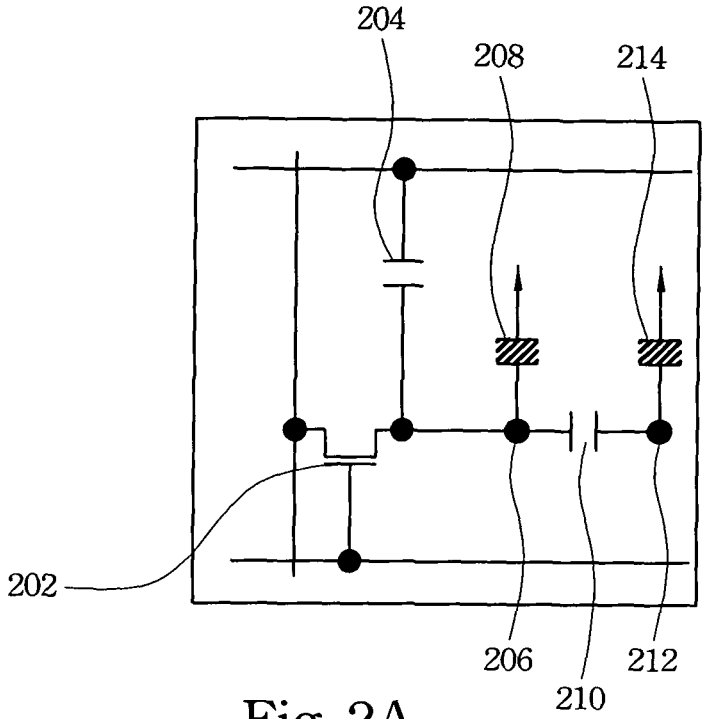
Fig. 2A (PRIOR ART)
FIG. 2A illustrates a typical CC type pixel unit.
Figure 2B:
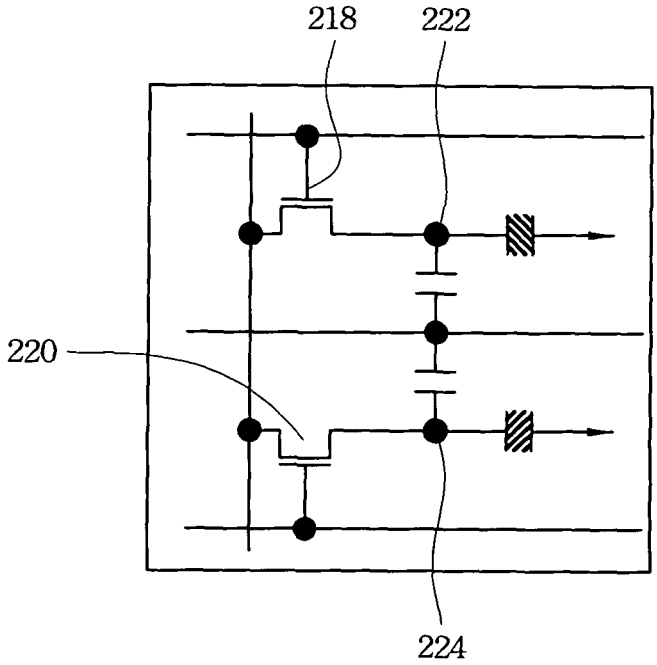
Fig. 2B (PRIOR ART)
FIG. 2B illustrates a typical TT type pixel unit.
Figure 2C:
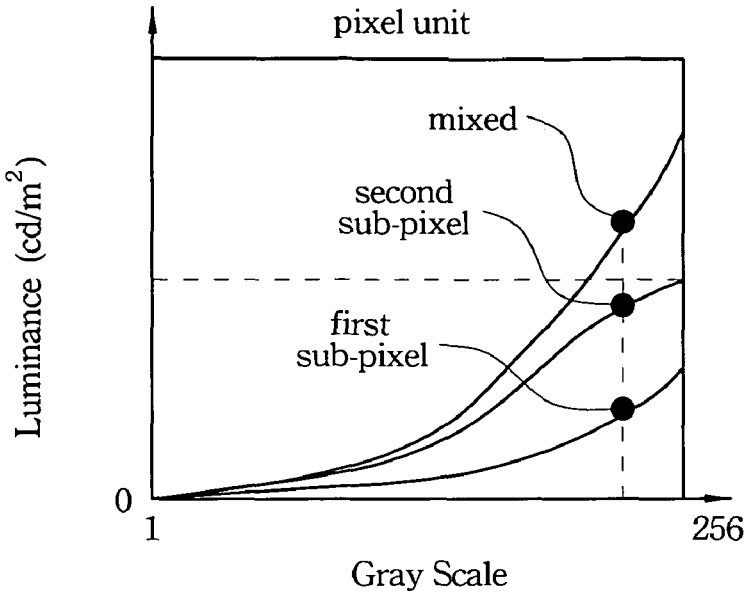
Fig. 2C (PRIOR ART)
FIG. 2C illustrates a Gamma characteristic curve diagram of a typical CC type pixel unit.
Figure 2D:
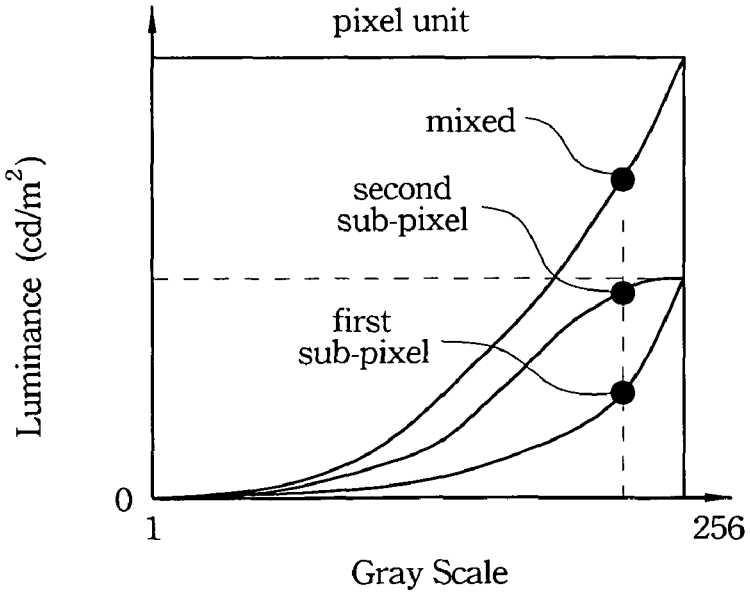
Fig. 2D (PRIOR ART)
FIG. 2D illustrates a Gamma characteristic curve diagram of a typical TT type pixel unit.
Figure 3:
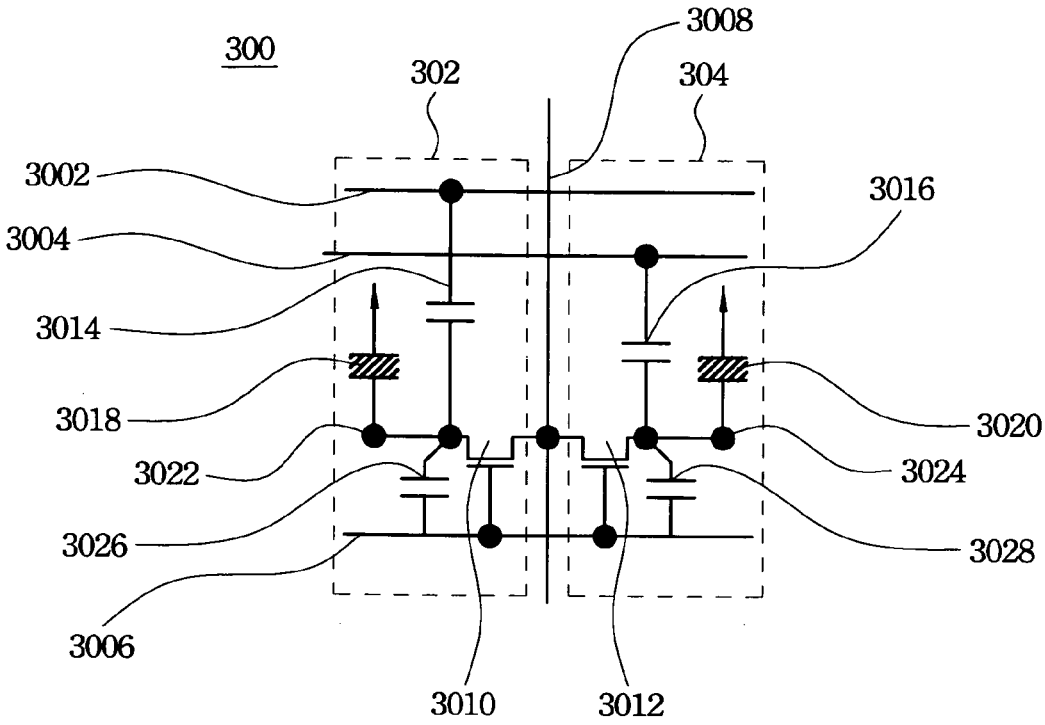
FIG. 3 illustrates a schematic diagram of a pixel unit according to the first embodiment of the present invention.

FIG. 3 is a schematic diagram of a pixel unit according to the first embodiment of the present invention. The pixel unit 300 includes two sub-pixels 302 and 304. The sub-pixel 302 includes a thin film transistor 3010. According to the thin film transistor 3010, the gate electrode is connected to the scanning line 3006, the drain electrode is connected to the data line 3008 and the source electrode is connected to the pixel electrode 3022. The storage capacitor 3014 is composed of the pixel electrode 3022 and the scanning line 3002. The liquid crystal capacitor 3018 is composed of the pixel electrode 3022 and the conductive electrode in the upper substrate (not shown in figure). A parasitical capacitor 3026 exists between the gate and the source electrode of the thin film transistor 3010.

The sub-pixel 304 includes a thin film transistor 3012. According to the thin film transistor 3012, the gate electrode is connected to the scanning line 3006, the drain electrode is connected to the data line 3008 and the source electrode is connected to the pixel electrode 3024. The storage capacitor 3016 is composed of the pixel electrode 3024 and the common electrode line 3004. The liquid crystal capacitor 3020 is composed of the pixel electrode 3024 and the conductive electrode in the upper substrate (not shown in figure). A parasitical capacitor 3028 exists between the gate and the source electrode of the thin film transistor 3012. According to this embodiment, the gate electrodes of the thin film transistors 3010 and 3012 are connected to the scanning line 3006. The drain electrodes of the thin film transistors 3010 and 3012 are connected to the data line 3008. Therefore, the two thin film transistors 3010 and 3012 are connected in parallel. In other words, the pixel electrodes 3022 and 3024 are not in the floating state. The charge aggregation phenomenon and the electric potential shift phenomenon do not happen. Moreover, only the scanning line 3002 and 3006, data line 3008 and the common electrode line 3004 are required to reduce the color shift in this embodiment. It is not necessary to increase the additional scanning line or electrical potential source in this embodiment.

Figure 4:
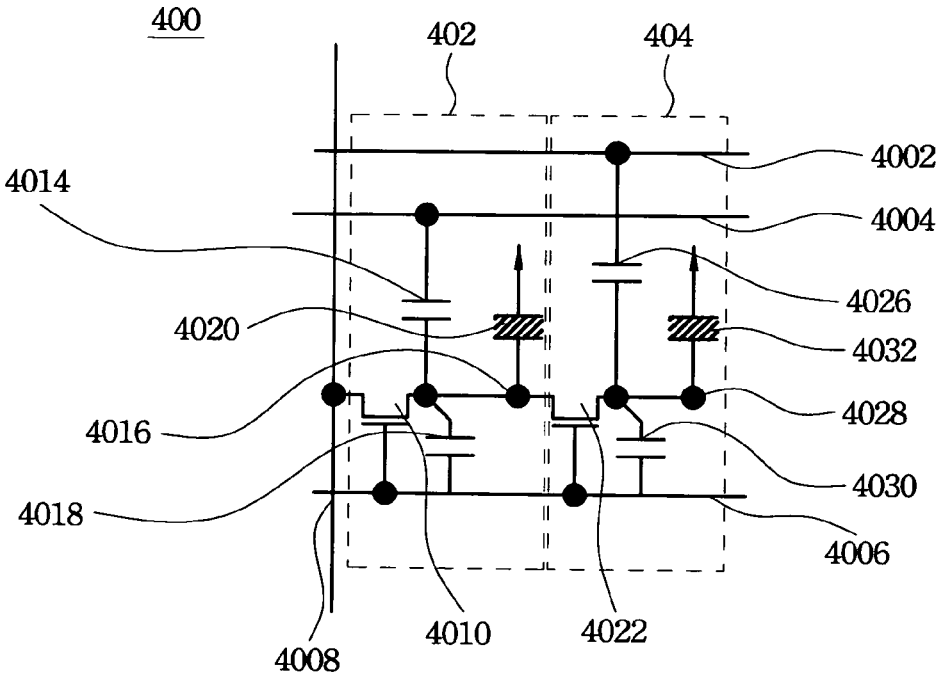
FIG. 4 illustrates a schematic diagram of a pixel unit according to the second embodiment of the present invention.

FIG. 4 is a schematic diagram of a pixel unit according to the second embodiment of the present invention. The pixel unit 400 includes two sub-pixels 402 and 404. The sub-pixel 402 includes a thin film transistor 4010. According to the thin film transistor 4010, the gate electrode is connected to the scanning line 4006, the drain electrode is connected to the data line 4008 and the source electrode is connected to the pixel electrode 4016. The storage capacitor 4014 is composed of the pixel electrode 4016 and the common electrode line 4004. The liquid crystal capacitor 4020 is composed of the pixel electrode 4016 and the conductive electrode in the upper substrate (not shown in figure). The source electrode of the thin film transistor 4010 is connected to the drain electrode of the thin film transistor 4022. A parasitical capacitor 4018 exists between the connection point and the gate of the thin film transistor 4010.

The sub-pixel 404 includes a thin film transistor 4022. According to the thin film transistor 4022, the gate electrode is connected to the scanning line 4006, the drain electrode is connected to the source electrode of the thin film transistor 4010 and the source electrode is connected to the pixel electrode 4028. The storage capacitor 4026 is composed of the pixel electrode 4028 and the scanning line 4002. The liquid crystal capacitor 4032 is composed of the pixel electrode 4028 and the conductive electrode in the upper substrate (not shown in figure). A parasitical capacitor 4030 exists between the gate and the source electrode of the thin film transistor 4022. According to this embodiment, the source electrode of the thin film transistor 4010 is connected to the drain electrode of the thin film transistor 4022. Therefore, the two thin film transistors 4010 and 4022 are connected in parallel. In other words, the pixel electrodes 4016 and 4028 are not in the floating state. The charge aggregation phenomenon and the electric potential shift phenomenon do not happen. Moreover, only the scanning line 4002 and 4006, data line 4008 and the common electrode line 4004 are required to reduce the color shift in this embodiment. It is not necessary to increase the additional scanning line or data line in this embodiment.

Figure 5:
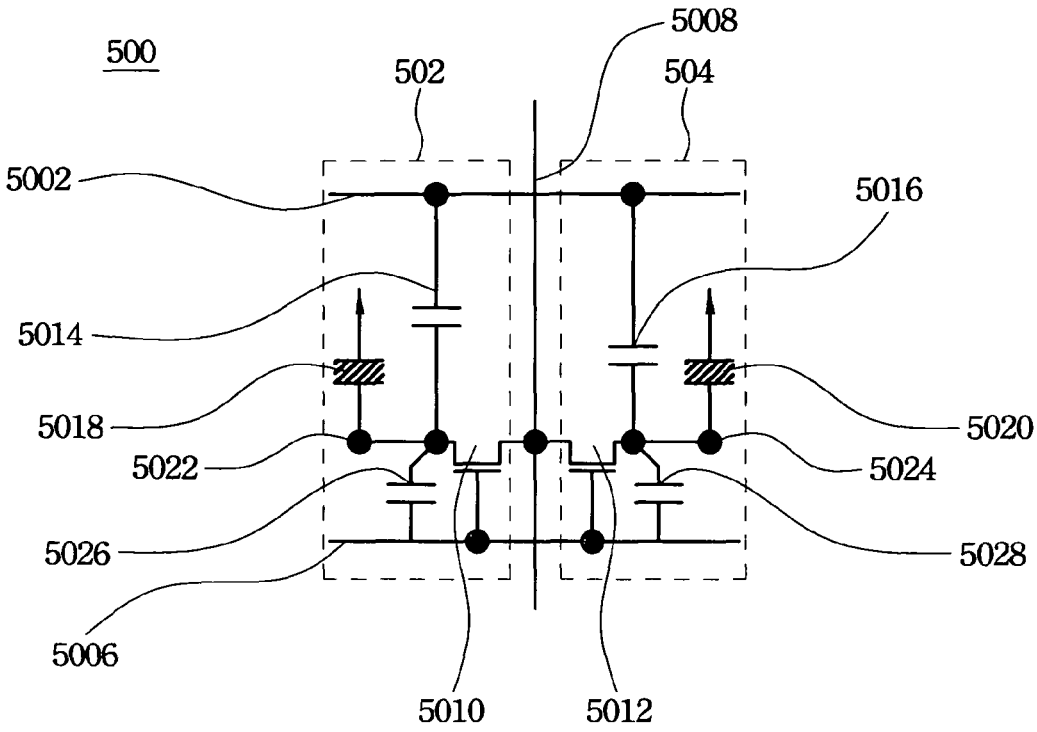
FIG. 5 illustrates a schematic diagram of a pixel unit according to the third embodiment of the present invention.

FIG. 5 is a schematic diagram of a pixel unit according to the third embodiment of the present invention. The pixel unit 500 includes two sub-pixels 502 and 504. The sub-pixel 502 includes a thin film transistor 5010. According to the thin film transistor 5010, the gate electrode is connected to the scanning line 5006, the drain electrode is connected to the data line 5008 and the source electrode is connected to the pixel electrode 5022. The storage capacitor 5014 is composed of the pixel electrode 5022 and the scanning line 5002. The liquid crystal capacitor 5018 is composed of the pixel electrode 5022 and the conductive electrode in the upper substrate (not shown in figure). A parasitical capacitor 5026 exists between the source electrode and the gate of the thin film transistor 5010.

The sub-pixel 504 includes a thin film transistor 5012. According to the thin film transistor 5012, the gate electrode is connected to the scanning line 5006, the drain electrode is connected to the data line 5008 and the source electrode is connected to the pixel electrode 5024. The storage capacitor 5016 is composed of the pixel electrode 5024 and the scanning line 5002. The liquid crystal capacitor 5020 is composed of the pixel electrode 5024 and the conductive electrode in the upper substrate (not shown in figure). A parasitical capacitor 5028 exists between the gate and the source electrode of the thin film transistor 5012. According to this embodiment, the gate electrodes of the thin film transistors 5010 and 5012 are connected to the scanning line 5006. The drain electrodes of the thin film transistors 5010 and 5012 are connected to the data line 5008. Therefore, the two thin film transistors 5010 and 5012 are connected in parallel. In other words, the pixel electrodes 5022 and 5024 are not in the floating state. The charge aggregation phenomenon and the electric potential shift phenomenon do not happen. Moreover, only the scanning line 5002 and 5006, data line 5008 and the common electrode line 5004 are required to reduce the color shift in this embodiment. It is not necessary to increase the additional scanning line or data line in this embodiment.

According to this embodiment, the storage capacitor 5014 is composed of the pixel electrode 5022 and the scanning line 5002. The storage capacitor 5016 is composed of the pixel electrode 5024 and the scanning line 5002. Therefore, the electric potential of the pixel electrodes 5022 and 5024 is separated by modifying the capacitance of the storage capacitor 5014 and 5016 and by a driving wave and the coupling effect of the storage capacitor 5014 and 5016. Moreover, the output range of the electric potential in the data line be reduced, which also reduces the power.

Figure 6:
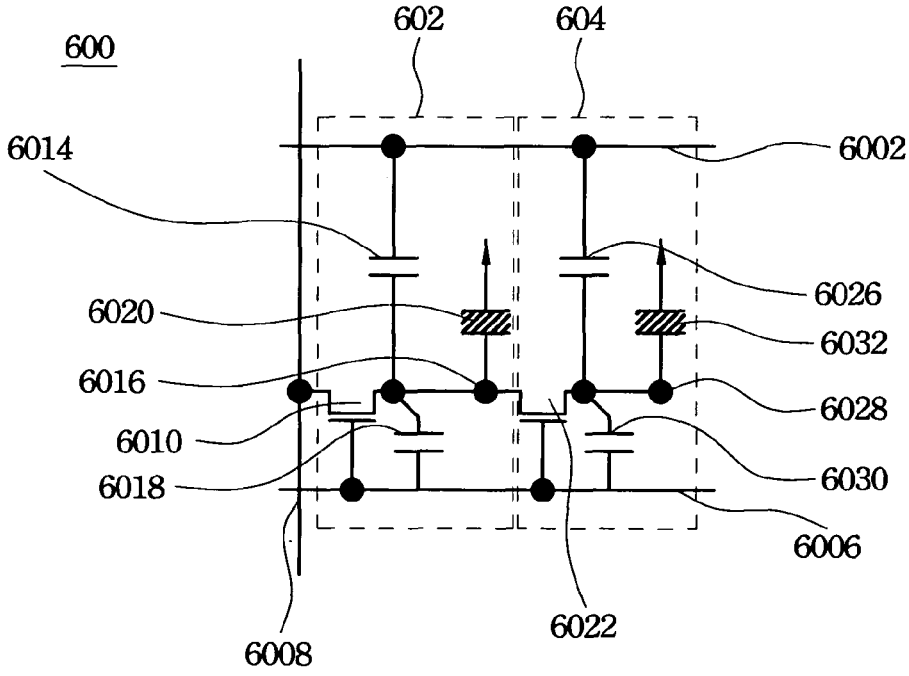
FIG. 6 illustrates a schematic diagram of a pixel unit according to the fourth embodiment of the present invention.

FIG. 6 is a schematic diagram of a pixel unit according to the fourth embodiment of the present invention. The pixel unit 600 includes two sub-pixels 602 and 604. The sub-pixel 602 includes a thin film transistor 6010. According to the thin film transistor 6010, the gate electrode is connected to the scanning line 6006, the drain electrode is connected to the data line 6008 and the source electrode is connected to the pixel electrode 6016. The storage capacitor 6014 is composed of the pixel electrode 6016 and the scanning line 6002. The liquid crystal capacitor 6020 is composed of the pixel electrode 6016 and the conductive electrode in the upper substrate (not shown in figure). The source electrode of the thin film transistor 6010 is connected to the drain electrode of the thin film transistor 6022. A parasitical capacitor 6018 exists between the connection point and the gate of the thin film transistor 6010.

The sub-pixel 604 includes a thin film transistor 6022. According to the thin film transistor 6022, the gate electrode is connected to the scanning line 6006, the drain electrode is connected to the source electrode of the thin film transistor 6010 and the source electrode is connected to the pixel electrode 6028. The storage capacitor 6026 is composed of the pixel electrode 6028 and the scanning line 6002. The liquid crystal capacitor 6032 is composed of the pixel electrode 6028 and the conductive electrode in the upper substrate (not shown in figure). A parasitical capacitor 6030 exists between the gate and the source electrode of the thin film transistor 6022. According to this embodiment, the source electrode of the thin film transistor 6010 is connected to the drain electrode of the thin film transistor 6022. Therefore, the two thin film transistors 6010 and 6022 are connected in series. In other words, the pixel electrodes 6016 and 6028 are not in the floating state. The charge aggregation phenomenon and the electric potential shift phenomenon do not happen. Moreover, only the scanning line 6002 and 6006 and the data line 6008 are required to reduce the color shift in this embodiment. It is not necessary to increase the additional scanning line or data line in this embodiment.

According to this embodiment, the storage capacitor 6014 is composed of the pixel electrode 6016 and the scanning line 6002. The storage capacitor 6026 is composed of the pixel electrode 6028 and the scanning line 6002. Therefore, the electric potential of the pixel electrodes 6016 and 6028 be separated by modifying the capacitance of the storage capacitor 6014 and 6026 and by a driving wave and the coupling effect of the storage capacitor 6014 and 6026. Moreover, the output range of the electric potential in the data line be reduced, which also reduces the power.

Figure 7:
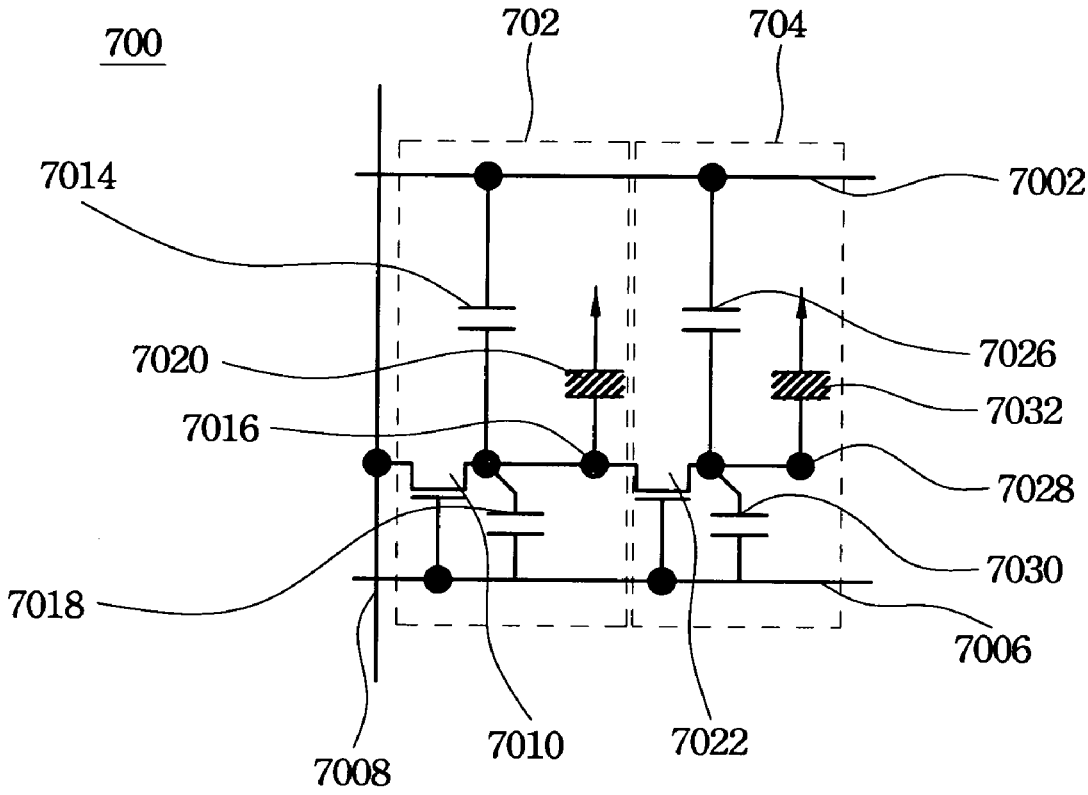
FIG. 7 illustrates a schematic diagram of a pixel unit according to the fifth embodiment of the present invention.

FIG. 7 is a schematic diagram of a pixel unit according to the fifth embodiment of the present invention. The main difference between this embodiment and the foregoing embodiments is that the two thin film transistors 7010 and 7022 have different design specifications. Based on the different design specifications, the two thin film transistors 7010 and 7022 have different charge capacities. Therefore, the electric potential of the pixel electrodes 7016 and 7028 can be separated.

The pixel unit 700 includes two sub-pixels 702 and 704. The sub-pixel 702 includes a thin film transistor 7010. According to the thin film transistor 7010, the gate electrode is connected to the scanning line 7006, the drain electrode is connected to the data line 7008 and the source electrode is connected to the pixel electrode 7016. The storage capacitor 7014 is composed of the pixel electrode 7016 and the bias line 7002. The liquid crystal capacitor 7020 is composed of the pixel electrode 7016 and the conductive electrode in the upper substrate (not shown in figure). The source electrode of the thin film transistor 7010 is connected to the drain electrode of the thin film transistor 7022. A parasitical capacitor 7018 exists between the connection point and the gate of the thin film transistor 7010.

The sub-pixel 704 includes a thin film transistor 7022. According to the thin film transistor 7022, the gate electrode is connected to the scanning line 7006, the drain electrode is connected to source electrode of the thin film transistor 7010 and the source electrode is connected to the pixel electrode 7028. The storage capacitor 7026 is composed of the pixel electrode 7028 and the bias line 7002. The liquid crystal capacitor 7032 is composed of the pixel electrode 7028 and the conductive electrode in the upper substrate (not shown in figure). A parasitical capacitor 7030 exists between the gate and the source electrode of the thin film transistor 7022. According to this embodiment, the source electrode of the thin film transistor 7010 is connected to the drain electrode of the thin film transistor 7022. Therefore, the two thin film transistors 7010 and 7022 are connected in series. In other words, the pixel electrodes 7016 and 7028 are not in the floating state. The charge aggregation phenomenon and the electric potential shift phenomenon do not happen. Moreover, only the bias line 7002 which be adjacent scanning line or common line, scanning line 7006 and the data line 7008 are required to reduce the color shift in this embodiment. It is not necessary to increase the additional scanning line or data line.

Figure 8:
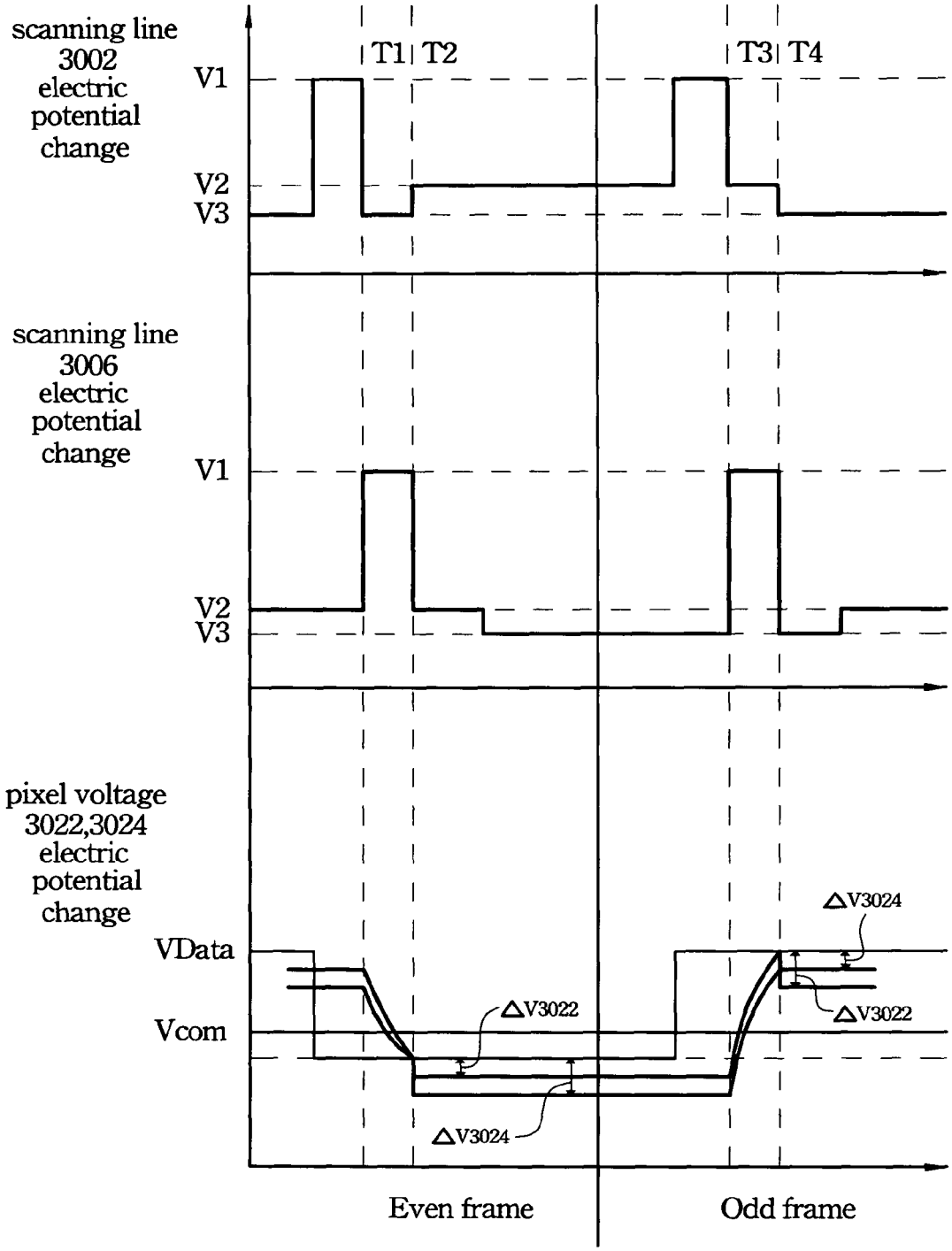
FIG. 8 illustrates the three-level drive waveform and the electric potential change of pixel electrodes according to an embodiment of the present invention.

FIG. 8 illustrates the three-level drive waveform and the electric potential change of pixel electrodes according to an embodiment of the present invention. Please refer to FIG. 8 and FIG. 3 together. In this embodiment, the drive waveform includes three electric potentials, V1, V2 and V3. The relationship among the three electric potentials is V1>V2>V3. The left part of FIG. 8 illustrates the corresponding waveform in the even frame. The right part of FIG. 8 illustrates the corresponding waveform in the odd frame.

During the time segment T1 of the even frame, the scanning line 3006 is selected. At this time, data with negative polarity is transferred in the data line 3008. The electric potential of the gate electrodes of the thin film transistors 3010 and 3012 is increased to V1 to turn on thin film transistor 3010 and 3012. The data in the data line 3008 is transferred to the pixel electrode 3022 through the thin film transistor 3010. The data in the data line 3008 is transferred to the pixel electrode 3024 through the thin film transistor 3012. When time segment T1 is almost over, the pixel electrodes 3022 and 3024 have the same electric potential. During the time segment T2, the electric potential on the scanning line 3006 is reduced to the electric potential V2 to turn off the thin film transistor 3010 and 3012. Therefore, the two pixel electrodes are isolated.

On the other hand, the scanning line 3006 is coupled to the pixel electrode 3022 and 3024 through the parasitical capacitors 3026 and 3028 respectively. Therefore, the electric potentials of the pixel electrodes 3022 and 3024 are affected by the electric potential variation (V1-V2) of the scanning line 3006 during the time segment T2.

Moreover, the scanning line 3002 is coupled to the pixel electrode 3022 through the storage capacitors 3014. Therefore, the electric potential of the pixel electrodes 3022 is also affected by the electric potential variation of the scanning line 3002. During the time segment T2, the electric potential of the scanning line 3002 is changed from V3 to V2. The increased electric potential variation (V2-V3) of the scanning line 3002 is coupled to the pixel electrode 3022 to reduce the absolute value of the electric potential of the pixel electrode 3022. Such variation separates the electric potential value between the pixel electrodes 3022 and 3024. The different electric potential value forms different Gamma curves to reach the Half-tone effect. Therefore, the electric potential difference between the pixel electrode 3022 and 3024 is changed by modifying the capacitance of the storage capacitor 3014 and 3016.

During the time segment T2, the electric potential variation of the pixel electrode 3024, ΔV(3024), is described in the following:

$$\Delta V(3024) = \frac{C_{gs}(3028)}{C_T(3024)}(V1 - V2),$$

and $$C_T(3024)=C_{lc}(3020)+C_{st}(3016)+C_{gs}(3028)$$

The $C_T$(3024) is the total capacitance related to the pixel electrode 3024. The $C_{lc}$(3020) is the capacitance of the liquid crystal capacitor 3020. The $C_{st}$(3016) is the capacitance of the storage capacitor 3016. The $C_{gs}$(3028) is the capacitance of the parasitical capacitor 3028.

During the time segment T2, the electric potential variation of the pixel electrode 3022, ΔV(3022), is described in the following:

$$\Delta V(3022) = \left|\frac{C_{gs}(3026)}{C_T(3022)}(V1 - V2) - \frac{C_{st}(3014)}{C_T(3022)}(V2 - V3)\right|,$$

and $$C_T(3022)=C_{lc}(3018)+C_{st}(3014)+C_{gs}(3026)$$

The $C_T$(3022) is the total capacitance related to the pixel electrode 3022. The $C_{lc}$(3018) is the capacitance of the liquid crystal capacitor 3018. The $C_{st}$(3014) is the capacitance of the storage capacitor 3014. The $C_{gs}$(3026) is the capacitance of the parasitical capacitor 3026.

Moreover, the $$\frac{C_{st}(3014)}{C_T(3022)}(V2 - V3)$$

is the electic potential variation value of the pixel electrode 3022 because of the coupling effect from the scanning line 3002.

In the odd frame, positive polarity data is transferred in the data line 3008. The main difference between the odd frame and the even frame is described in the following. During the time segment T1 of the even frame, the three-level drive waveform for driving the scanning line 3002 is pulled down to the lowest electric potential V3. Then, during the time segment T2 of the even frame, the three-level drive waveform for driving the scanning line 3002 is pulled up to the electric potential V2. Such a drive waveform reduces the absolute value of the electric potential variation in the pixel electrode 3022.

However, the drive waveform in the odd frame is different from the drive waveform in the even frame. During the time segment T3 of the odd frame, the three-level drive waveform for driving the scanning line 3002 is pulled down to the electric potential V2. During the time segment T4 of the odd frame, the three-level drive waveform for driving the scanning line 3006 is pulled down to the lowest electric potential V3 to turn off the thin film transistor 3010 and 3012. Then, the three-level drive waveform for driving the scanning line 3002 is first pulled down to the lowest electric potential V3. Such a drive waveform increases the absolute value of the electric potential variation in the pixel electrode 3022.

During the time segment T4, the electric potential variation of the pixel electrode 3024, ΔV(3024), is described in the following:

$$\Delta V(3024) = \frac{C_{gs}(3028)}{C_T(3024)}(V1 - V3),$$

and $$C_T(3024)=C_{lc}(3020)+C_{st}(3016)+C_{gs}(3028)$$

The $C_T$(3024) is the total capacitance related to the pixel electrode 3024. The $C_{lc}$(3020) is the capacitance of the liquid crystal capacitor 3020. The $C_{st}$(3016) is the capacitance of the storage capacitor 3016. The $C_{gs}$(3028) is the capacitance of the parasitical capacitor 3028.

During the time segment T4, the electric potential variation of the pixel electrode 3022, ΔV(3022), is described in the following:

$$\Delta V(3022) = \frac{C_{gs}(3026)}{C_T(3022)}(V1 - V3) + \frac{C_{st}(3014)}{C_T(3022)}(V2 - V3),$$

and $$C_T(3022)=C_{lc}(3018)+C_{st}(3014)+C_{gs}(3026)$$

The $C_T$(3022) is the total capacitance related to the pixel electrode 3022. The $C_{lc}$(3018) is the capacitance of the liquid crystal capacitor 3018. The $C_{st}$(3014) is the capacitance of the storage capacitor 3014. The $C_{gs}$(3026) is the capacitance of the parasitical capacitor 3026.

The foregoing application of the drive waveform illustrated in FIG. 8 is based on the pixel unit 300 of the first embodiment in FIG. 3. However, it is noticed that the drive waveform illustrated in FIG. 8 also is used in the pixel unit 400 of the second embodiment in FIG. 4, in the pixel unit 500 of the third embodiment in FIG. 5 and in the pixel unit 600 of the fourth embodiment in FIG. 6.

Figure 9:
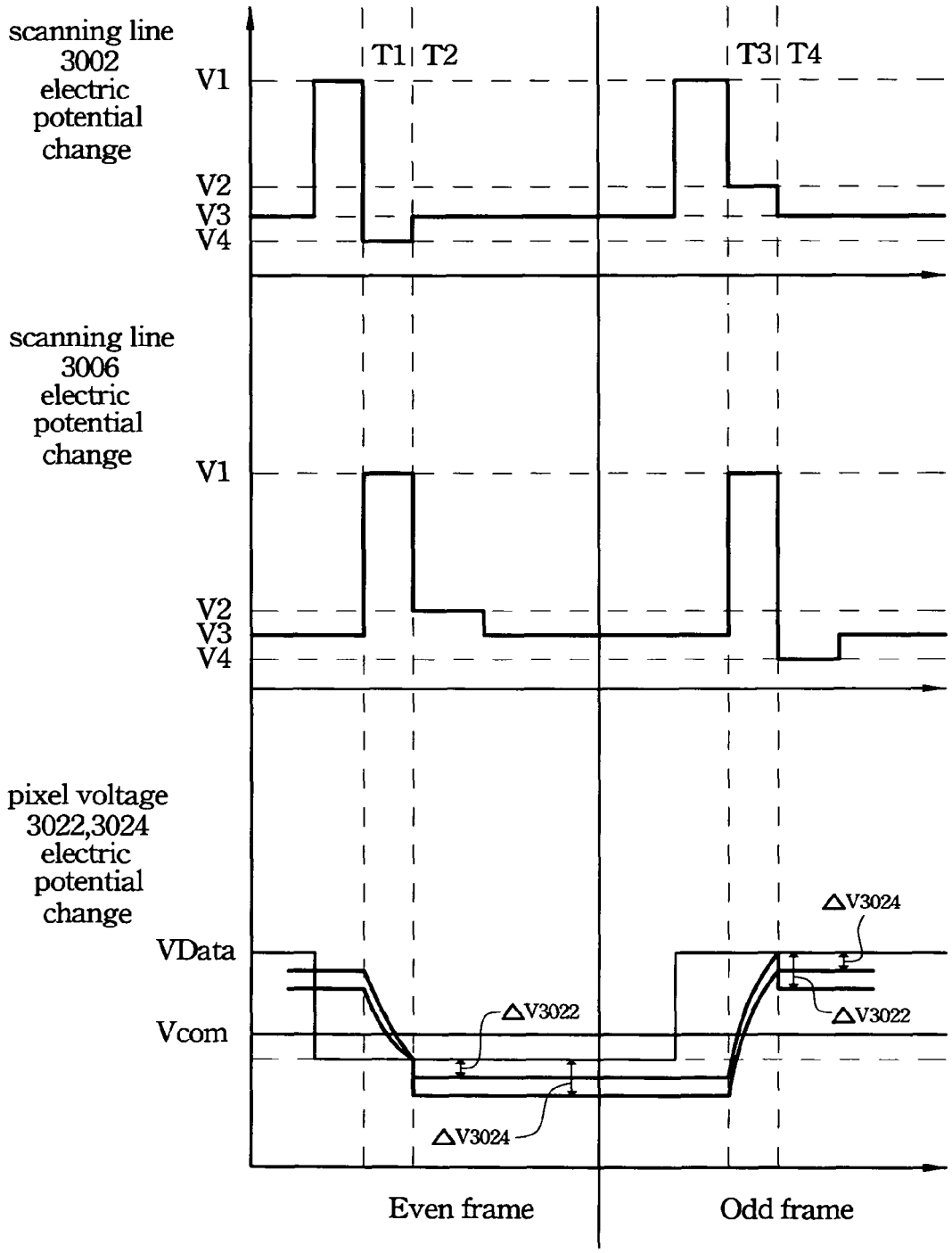
FIG. 9 illustrates the four-level drive waveform and the electric potential change of pixel electrodes according to an embodiment of the present invention.

FIG. 9 illustrates the four-level drive waveform and the electric potential change of pixel electrodes according to an embodiment of the present invention. Please refer to FIG. 9 and FIG. 3 together. In this embodiment, the drive waveform includes four electric potential, V1, V2, V3 and V4. The relationship among the three electric potential is V1>V2>V3>V4. The left part of FIG. 9 illustrates the corresponding waveform in the even frame. The right part of FIG. 9 illustrates the corresponding waveform in the odd frame.

During the time segment T1 of the even frame, the scanning line 3006 is selected. The electric potential of the scanning line 3002 is pulled down to the electric potential V4. At this time, negative polarity data is transferred in the data line 3008. The electric potential of the gate electrodes of the thin film transistors 3010 and 3012 is increased to V1 to turn on the thin film transistors 3010 and 3012. The data in the data line 3008 is transferred to the pixel electrode 3022 through the thin film transistor 3010. The data in the data line 3008 is transferred to the pixel electrode 3024 through the thin film transistor 3012. When the time segment T1 is almost over, the pixel electrodes 3022 and 3024 have the same electric potential. During the time segment T2, the electric potential on the scanning line 3006 is pulled down to the electric potential V2 to turn off the thin film transistor 3010 and 3012. At this moment, the electric potential on the scanning line 3002 is pulled up from the electric potential V4 to the electric potential V3.

On the other hand, the scanning line 3006 is coupled to the pixel electrode 3022 and 3024 through the parasitical capacitors 3026 and 3028 respectively. Therefore, the electric potential of the pixel electrodes 3022 and 3024 is affected by the electric potential variation (V1-V2) of the scanning line 3006 during the time segment T2.

Moreover, the scanning line 3002 is coupled to the pixel electrode 3022 through the storage capacitors 3014. Therefore, the electric potential of the pixel electrode 3022 is also affected by the electric potential variation of the scanning line 3002. During the time segment T2 of the even frame, the electric potential of the scanning line 3002 is pulled up from the electric potential V4 to the electric potential V3. The electric potential variation (V3-V4) of the scanning line 3002 is coupled to the pixel electrode 3022 to reduce the absolute value of the electric potential of the pixel electrode 3022.

Such variation separates the electric potential value between the pixel electrodes 3022 and 3024. The different electric potential value between the pixel electrodes 3022 and 3024 forms different Gamma curves to reach the Half-tone effect.

During the time segment T2, the electric potential variation of the pixel electrode 3024, ΔV(3024), is described in the following:

$$\Delta V(3024) = \frac{C_{gs}(3028)}{C_T(3024)}(V1 - V2),$$

and $$C_T(3024)=C_{lc}(3020)+C_{st}(3016)+C_{gs}(3028)$$

The $C_T$(3024) is the total capacitance related to the pixel electrode 3024. The $C_{lc}$(3020) is the capacitance of the liquid crystal capacitor 3020. The $C_{st}$(3016) is the capacitance of the storage capacitor 3016. The $C_{gs}$(3028) is the capacitance of the parasitical capacitor 3028.

During time segment T2, the electric potential variation of the pixel electrode 3022, ΔV(3022), is described in the following:

$$\Delta V(3022) = \left|\frac{C_{gs}(3026)}{C_T(3022)}(V1 - V2) - \frac{C_{st}(3014)}{C_T(3022)}(V3 - V4)\right|,$$

and $$C_T(3022)=C_{lc}(3018)+C_{st}(3014)+C_{gs}(3026)$$

The $C_T$(3022) is the total capacitance related to the pixel electrode 3022: The $C_{lc}$(3018) is the capacitance of the liquid crystal capacitor 3018. The $C_{st}$(3014) is the capacitance of the storage capacitor 3014. The $C_{gs}$(3026) is the capacitance of the parasitical capacitor 3026. Moreover, the $$\frac{C_{st}(3014)}{C_T(3022)}(V3 - V4)$$

is the electric potential variation of the pixel electrode 3022 because of the coupling effect from the scanning line 3002.

In the odd frame of FIG. 9, positive polarity data is transferred in the data line 3008. Please refer to FIG. 9 and FIG. 3 together. During the time segment T3 of the odd frame, the four step drive waveform for driving the scanning line 3006 is pulled up to the electric potential V1 to turn on the thin film transistors 3010 and 3012. When the time segment T3 is almost over, the pixel electrodes 3022 and 3024 have the same electric potential. At this time, the electric potential of the scanning line 3002 is pulled down to the electric potential V2. During the time segment T4 of the odd frame, the four-level drive waveform for driving the scanning line 3006 is pulled down to the lowest electric potential V4 to turn off the thin film transistor 3010 and 3012. At this time, the drive waveform for driving the scanning line 3002 is pulled down to the electric potential V3. The electric potential variation (V2-V3) of the scanning line 3002 is coupled to the pixel electrode 3022 through the storage capacitor 3014 to increase the absolute value of the electric potential variation of the pixel electrode 3022. Such variation separates the electric potential value between the pixel electrodes 3022 and 3024. The different electric potential values between the pixel electrodes 3022 and 3024 form different Gamma curves to reach the Half-tone effect. The advantage of using a four-level drive waveform is that more parameters be used to change the electric potential of the pixel electrodes 3022 and 3024. Therefore, more electric potential difference variation between the pixel electrodes 3022 and 3024 is obtained to improve the color performance of the liquid crystal display.

During the time segment T4, the electric potential variation of the pixel electrode 3024, ΔV(3024), is described in the following:

$$\Delta V(3024) = \frac{C_{gs}(3028)}{C_T(3024)}(V1 - V4),$$

and $$C_T(3024)=C_{lc}(3020)+C_{st}(3016)+C_{gs}(3028)$$

The $C_T$(3024) is the total capacitance related to the pixel electrode 3024. The $C_{lc}$(3020) is the capacitance of the liquid crystal capacitor 3020. The $C_{st}$(3016) is the capacitance of the storage capacitor 3016. The $C_{gs}$(3028) is the capacitance of the parasitical capacitor 3028.

During the time segment T4, the electric potential variation of the pixel electrode 3022, ΔV(3022), is described in the following:

$$\Delta V(3022) = \frac{C_{gs}(3026)}{C_T(3022)}(V1 - V4) + \frac{C_{st}(3014)}{C_T(3022)}(V2 - V3),$$

and $$C_T(3022)=C_{lc}(3018)+C_{st}(3014)+C_{gs}(3026)$$

The $C_T$(3022) is the total capacitance related to the pixel electrode 3022. The $C_{lc}$(3018) is the capacitance of the liquid crystal capacitor 3018. The $C_{st}$(3014) is the capacitance of the storage capacitor 3014. The $C_{gs}$(3026) is the capacitance of the parasitical capacitor 3026.

The foregoing application of the drive waveform illustrated in FIG. 9 is based on the pixel unit 300 of the first embodiment in FIG. 3. However, it is noticed that the drive waveform illustrated in FIG. 9 also be used in the pixel unit 400 of the second embodiment in FIG. 4, in the pixel unit 500 of the third embodiment in FIG. 5 and in the pixel unit 600 of the fourth embodiment in FIG. 6.

Figure 10:
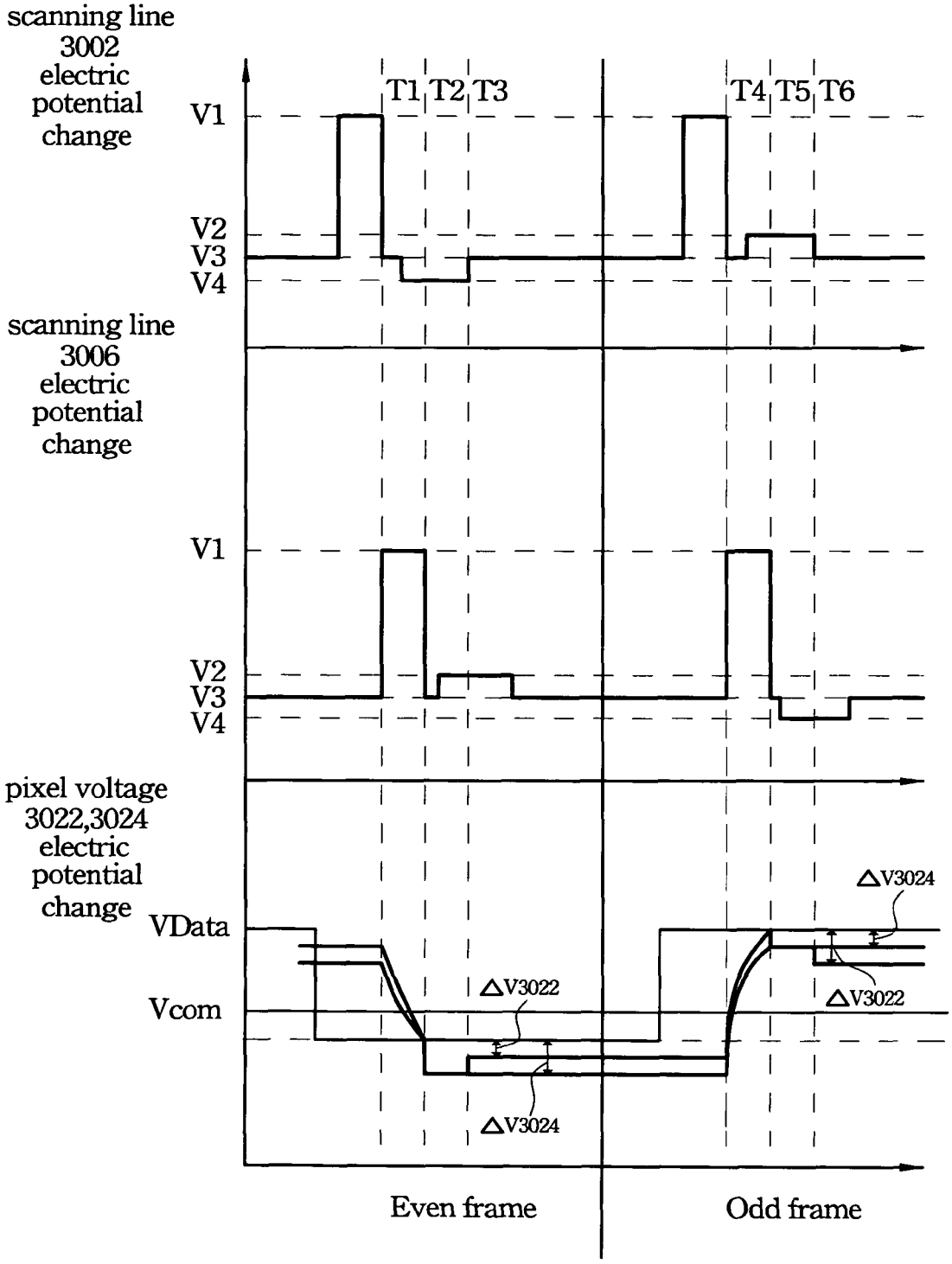
FIG. 10 illustrates the two steps four-level drive waveform and the electric potential change of pixel electrodes according to an embodiment of the present invention.

FIG. 10 illustrates the two steps four-level drive waveform and the electric potential change of pixel electrodes according to an embodiment of the present invention. Please refer to FIG. 10 and FIG. 3 together. In this embodiment, the drive waveform includes four electric potential, V1, V2, V3 and V4. The relationship among the three electric potential is V1>V2>V3>V4. In this two-steps four-level drive waveform, the waveform transition is always from electric potential V3 to the destination electric potential. Such transition avoids the problems of data mistake due to time delay and drive waveform un-uniform. The left part of FIG. 10 illustrates the corresponding waveform in the even frame. The right part of FIG. 10 illustrates the corresponding waveform in the odd frame.

During the time segment T1 of the even frame, the scanning line 3006 is selected. The electric potential of the scanning line 3006 is pulled up to the electric potential V1 to turn on the thin film transistors 3010 and 3012. The data in the data line 3008 is transferred to the pixel electrode 3022 through the thin film transistor 3010. The data in the data line 3008 is transferred to the pixel electrode 3024 through the thin film transistor 3012. When the time segment T1 being almost over, the pixel electrodes 3022 and 3024 have the same electric potential. At this time, the electric potential of the scanning line 3002 is pulled down to the electric potential V4 from the electric potential V3. During the time segment T2, the electric potential on the scanning line 3006 is pulled down to the electric potential V2 to turn off the thin film transistor 3010 and 3012. At this moment, the electric potential of the scanning line 3006 is first pulled down to the electric potential V3, then, to the electric potential V2 to turn off the thin film transistor 3010 and 3012.

On the other hand, the scanning line 3006 is coupled to the pixel electrode 3022 and 3024 through the parasitical capacitors 3026 and 3028 respectively. Therefore, the electric potential of the pixel electrodes 3022 and 3024 is affected by the electric potential variation (V1-V2) of the scanning line 3006 during the time segment T2. In this time segment T2, the pixel electrodes 3022 and 3024 have the same electric potential.

During the time segment T3, the electric potential of the scanning line 3002 is pulled up from the electric potential V4 to the electric potential V3. The scanning line 3002 is coupled to the pixel electrode 3022 through the storage capacitors 3014. Therefore, the electric potential variation of the scanning line 3002 affects the electric potential of the pixel electrode 3022. The electric potential variation (V3-V4) of the scanning line 3002 is coupled to the pixel electrode 3022 to reduce the absolute value of the electric potential of the pixel electrode 3022. Such variation separates the electric potential value between the pixel electrodes 3022 and 3024. The different electric potential value between the pixel electrodes 3022 and 3024 forms different Gamma curves to reach the Half-tone effect.

During the time segment T3, the electric potential variation of the pixel electrode 3024, ΔV(3024), is described in the following:

$$\Delta V(3024) = \frac{C_{gs}(3028)}{C_T(3024)}(V1 - V2),$$

and $$C_T(3024)=C_{lc}(3020)+C_{st}(3016)+C_{gs}(3028)$$

The $C_T$(3024) is the total capacitance related to the pixel electrode 3024. The $C_{lc}$(3020) is the capacitance of the liquid crystal capacitor 3020. The $C_{st}$(3016) is the capacitance of the storage capacitor 3016. The $C_{gs}$(3028) is the capacitance of the parasitical capacitor 3028.

During the time segment T3, the electric potential variation of the pixel electrode 3022, ΔV(3022), is described in the following:

$$\Delta V(3022) = \left|\frac{C_{gs}(3026)}{C_T(3022)}(V1 - V2) - \frac{C_{st}(3014)}{C_T(3022)}(V3 - V4)\right|,$$

and $$C_T(3022)=C_{lc}(3018)+C_{st}(3014)+C_{gs}(3026)$$

The $C_T$(3022) is the total capacitance related to the pixel electrode 3022. The $C_{lc}$(3018) is the capacitance of the liquid crystal capacitor 3018. The $C_{st}$(3014) is the capacitance of the storage capacitor 3014. The $C_{gs}$(3026) is the capacitance of the parasitical capacitor 3026.

Moreover, the $$\frac{C_{st}(3014)}{C_T(3022)}(V3 - V4)$$

is the electric potential variation of the pixel electrode 3022 because of the coupling effect from the scanning line 3002.

In the odd frame of FIG. 10, positive polarity data is transferred in the data line 3008. Please refer to FIG. 10 and FIG. 3 together. During the time segment T4 of the odd frame, the drive waveform for driving the scanning line 3006 is pulled up to the electric potential V1 to turn on the thin film transistors 3010 and 3012. When the time segment T4 being almost over, the pixel electrodes 3022 and 3024 almost have the same electric potential. During the time segment T4, the electric potential of the scanning line 3002 is first pulled down to the electric potential V3, then, pulled up the electric potential V2. During the time segment T5 of the odd frame, the drive waveform for the driving the scanning line 3006 is pulled down to the lowest electric potential V4 to turn off the thin film transistor 3010 and 3012. At this time, the pixel electrode 3022 is isolated to the pixel electrode 3024. The pixel electrodes 3022 and 3024 almost have the same electric potential. During the time segment T6 of the odd frame, the drive waveform for driving the scanning line 3002 is pulled down to the electric potential V3. The electric potential variation (V2-V3) of the scanning line 3002 is coupled to the pixel electrode 3022 through the storage capacitor 3014 to increase the absolute value of the electric potential variation of the pixel electrode 3022. Such variation separates the electric potential value between the pixel electrodes 3022 and 3024. The different electric potential value between the pixel electrodes 3022 and 3024 forms different Gamma curves to reach the Half-tone effect. The advantage of using four-level drive waveform is that more parameters are used to change the electric potential of the pixel electrodes 3022 and 3024. Therefore, more electric potential difference variation between the pixel electrodes 3022 and 3024 is obtained to improve the color performance of the liquid crystal display.

During the time segment T6, the electric potential variation of the pixel electrode 3024, ΔV(3024), is described in the following:

$$\Delta V(3024) = \frac{C_{gs}(3028)}{C_T(3024)}(V1 - V4),$$

and $$C_T(3024)=C_{lc}(3020)+C_{st}(3016)+C_{gs}(3028)$$

The $C_T$(3024) is the total capacitance related of the pixel electrode 3024. The $C_{lc}$(3020) is the capacitance of the liquid crystal capacitor 3020. The $C_{st}$(3016) is the capacitance of the storage capacitor 3016. The $C_{gs}$(3028) is the capacitance of the parasitical capacitor 3028.

During the time segment T6, the electric potential variation of the pixel electrode 3022, ΔV(3022), is described in the following:

$$\Delta V(3022) = \frac{C_{gs}(3026)}{C_T(3022)}(V1 - V4) + \frac{C_{st}(3014)}{C_T(3022)}(V2 - V3),$$

and $$C_T(3022)=C_{lc}(3018)+C_{st}(3014)+C_{gs}(3026)$$

The $C_T$(3022) is the total capacitance related to the pixel electrode 3022. The $C_{lc}$(3018) is the capacitance of the liquid crystal capacitor 3018. The $C_{st}$(3014) is the capacitance of the storage capacitor 3014. The $C_{gs}$(3026) is the capacitance of the parasitical capacitor 3026.

The foregoing application of the drive waveform illustrated in FIG. 10 is based on the pixel unit 300 of the first embodiment in FIG. 3. However, it is noticed that the drive waveform illustrated in FIG. 10 also be used in the pixel unit 400 of the second embodiment in FIG. 4, in the pixel unit 500 of the third embodiment in FIG. 5 and in the pixel unit 600 of the fourth embodiment in FIG. 6.

Figure 11:
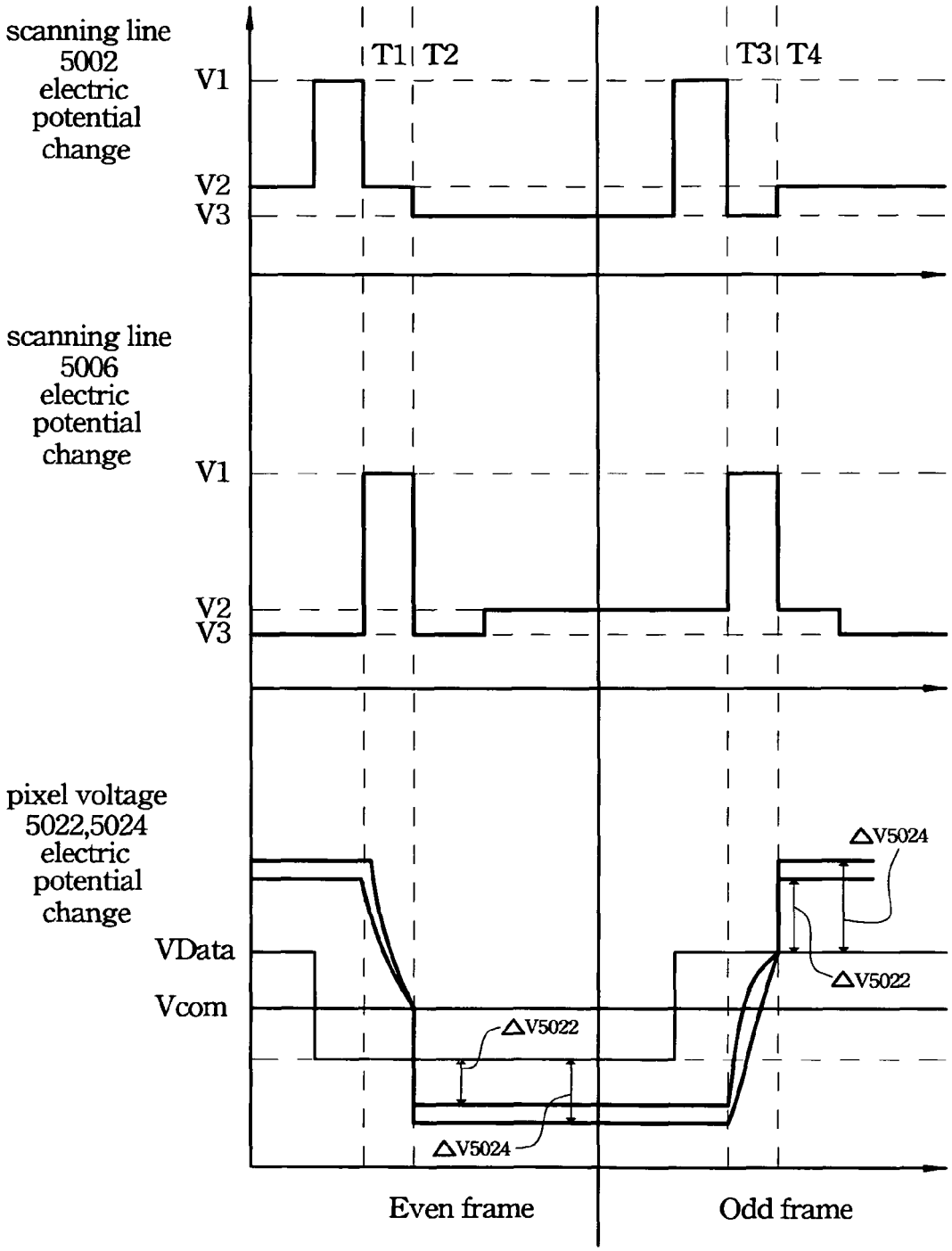
FIG. 11 illustrates the three-level drive waveform and the electric potential change of pixel electrodes according to an embodiment of the present invention.

FIG. 11 illustrates the three-level drive waveform and the electric potential change of pixel electrodes according to an embodiment of the present invention. Please refer to FIG. 11 and FIG. 5 together. In this embodiment, the drive waveform includes three electric potentials, V1, V2 and V3. The relationship among the three electric potential is V1>V2>V3. The left part of FIG. 11 illustrates the corresponding waveform in the even frame. The right part of FIG. 11 illustrates the corresponding waveform in the odd frame.

During the time segment T1 of the even frame, the scanning line 5006 is selected. At this time, a negative polarity data is transferred in the data line 5008. The electric potential of the gate electrodes of the thin film transistors 5010 and 5012 is increased to V1 to turn on the thin film transistor 5010 and 5012. The data in the data line 5008 is transferred to the pixel electrode 5022 through the thin film transistor 5010. The data in the data line 5008 is transferred to the pixel electrode 5024 through the thin film transistor 5012. When the time segment T1 is almost over, the pixel electrodes 5022 and 5024 have the same electric potential. During the time segment T2, the electric potential applied to the scanning line 5006 is reduced to the electric potential V3 to turn off the thin film transistor 5010 and 5012. Therefore, the two pixel electrodes are isolated.

On the other hand, the scanning line 5006 is coupled to the pixel electrode 5022 through the parasitical capacitors 5026. The scanning line 5006 is coupled to the pixel electrode 5024 through the parasitical capacitors 5028. Therefore, the electric potential of the pixel electrodes 5022 and 5024 is affected by the electric potential variation (V1-V3) of the scanning line 5006 during the time segment T2.

Moreover, the scanning line 5002 is coupled to the pixel electrode 5022 through the storage capacitors 5014. The scanning line 5002 is coupled to the pixel electrode 5024 through the storage capacitors 5016. Therefore, the electric potentials of the pixel electrodes 5022 and 5024 are also affected by the electric potential variation of the scanning line 5002. During the time segment T2, the electric potential of the scanning line 5002 is changed from electric potential V2 to electric potential V3. The reduced electric potential variation (V2-V3) of the scanning line 5002 is coupled to the pixel electrodes 5022 and 5024. The electric potentials of the pixel electrodes 5022 and 5024 are separated by modifying the capacitance of the storage capacitors 5014 and 5016. The different electric potential value forms different Gamma curves to reach the Half-tone effect. The coupling effect of the scanning lines reduces the electrical potential output range of the data line to reduce the power.

During the time segment T2, the electric potential variation of the pixel electrode 5024, ΔV(5024), is described in the following:

$$\Delta V(5024)=\left|\frac{C_{gs}(5028)}{C_T(5024)}(V1-V3)+\frac{C_{st}(5016)}{C_T(5024)}(V2-V3)\right|,$$

and $$C_T(5024)=C_{lc}(5020)+C_{st}(5016)+C_{gs}(5028)$$

The $C_T$(5024) is the total capacitance related to the pixel electrode 5024. The $C_{lc}$(5020) is the capacitance of the liquid crystal capacitor 5020. The $C_{lc}$(5016) is the capacitance of the storage capacitor 5016. The $C_{gs}$(5028) is the capacitance of the parasitical capacitor 5028.

Moreover, the $$\frac{C_{st}(5016)}{C_T(5024)}(V2-V3)$$

is the electric potential variation value of the pixel electrode 5024 because of the coupling effect from the scanning line 5002.

During the time segment T2, the electric potential variation of the pixel electrode 5022, ΔV(5022), is described in the following:

$$\Delta V(5022)=\frac{C_{gs}(5026)}{C_T(5022)}(V1-V3)+\frac{C_{st}(5014)}{C_T(5022)}(V2-V3),$$

and $$C_T(5022)=C_{lc}(5018)+C_{st}(5014)+C_{gs}(5026)$$

The $C_T$(5022) is the total capacitance related to the pixel electrode 5022. The $C_{lc}$(5018) is the capacitance of the liquid crystal capacitor 5018. The $C_{st}$(5014) is the capacitance of the storage capacitor 5014. The $C_{gs}$(5026) is the capacitance of the parasitical capacitor 5026.

Moreover, the $$\frac{C_{st}(5014)}{C_T(5022)}(V2-V3)$$

is the electric potential variation value of the pixel electrode 5022 because of the coupling effect from the scanning line 5002.

In the odd frame, positive polarity data is transferred in the data line 5008. Please refer to FIG. 11 and FIG. 5 together. The main difference between the odd frame and the even frame is described in the following. During the time segment T2 of the even frame, the drive waveform for driving the scanning line 5002 is pulled down to the lowest electric potential V3 from the electric potential V2. Such a driving waveform increases the absolute value of the electric potential variation in the pixel electrodes 5022 and 5024 caused by the electric potential variation (V1-V3) of the scanning line 5006.

However, the drive waveform in the odd frame is different from the drive waveform in the even frame. During the time segment T4 of the odd frame, the drive waveform for driving the scanning line 5006 is pulled down to the electric potential V2 from the electric potential V1 to turn off the thin film transistor 5010 and 5012. The drive waveform for driving the scanning line 5002 is pulled up to the electric potential V2 from the electric potential V3. Such drive waveforms increase the absolute value of the electric potential variation in the pixel electrodes 5022 and 5024 caused by the electric potential variation (V1-V2) of the scanning line 5006.

During the time segment T4, the electric potential variation of the pixel electrode 5024, ΔV(5024), is described in the following:

$$\Delta V(5024) = \left|\frac{C_{gs}(5028)}{C_T(5024)}(V1 - V2) - \frac{C_{st}(5016)}{C_T(5024)}(V2 - V3)\right|,$$

and $$C_T(5024)=C_{lc}(5020)+C_{st}(5016)+C_{gs}(5028)$$

The $C_T$(5024) is the total capacitance related to the pixel electrode 5024. The $C_{lc}$(5020) is the capacitance of the liquid crystal capacitor 5020. The $C_{st}$(5016) is the capacitance of the storage capacitor 5016. The $C_{gs}$(5028) is the capacitance of the parasitical capacitor 5028.

During the time segment T4, the electric potential variation of the pixel electrode 5022, ΔV(5022), is described in the following:

$$\Delta V(5022) = \left|\frac{C_{gs}(5026)}{C_T(5022)}(V1 - V2) - \frac{C_{st}(5014)}{C_T(5022)}(V2 - V3)\right|,$$

and $$C_T(5022)=C_{lc}(5018)+C_{st}(5014)+C_{gs}(5026)$$

The $C_T$(5022) is the total capacitance related to the pixel electrode 5022. The $C_{lc}$(5018) is the capacitance of the liquid crystal capacitor 5018. The $C_{st}$(5014) is the capacitance of the storage capacitor 5014. The $C_{gs}$(5026) is the capacitance of the parasitical capacitor 5026.

The foregoing application of the drive waveform illustrated in FIG. 11 is based on the pixel unit 500 of the first embodiment in FIG. 5. However, it is noticed that the drive waveform illustrated in FIG. 11 also be used in the pixel unit 600 of the fourth embodiment in FIG. 6.

Figure 12:
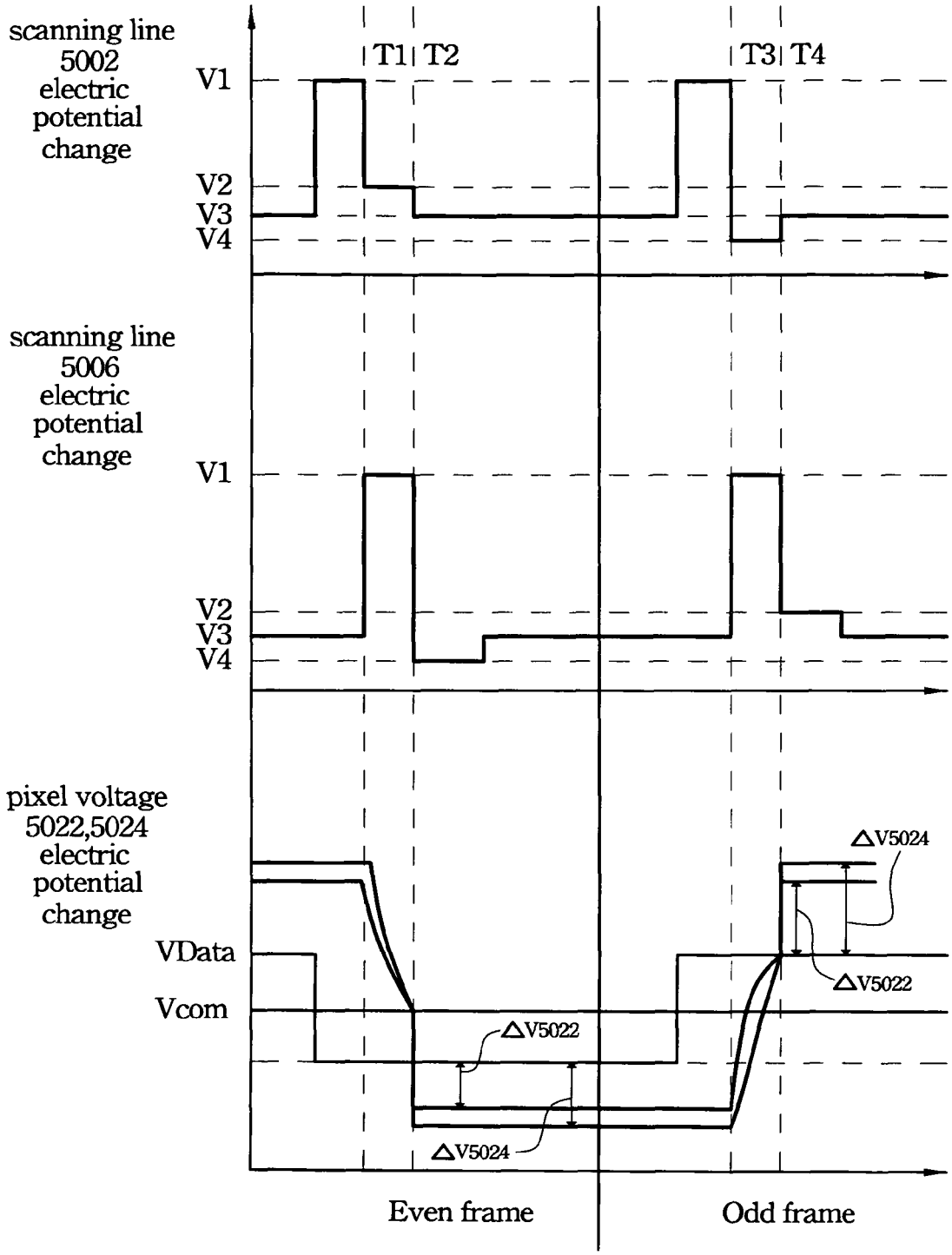
FIG. 12 illustrates the four-level drive waveform and the electric potential change of pixel electrodes according to an embodiment of the present invention.

FIG. 12 illustrates the four-level drive waveform and the electric potential change of pixel electrodes according to an embodiment of the present invention. Please refer to FIG. 12 and FIG. 5 together. In this embodiment, the drive waveform includes four electric potentials, V1, V2, V3 and V4. The relationship among the three electric potential is V1>V2>V3>V4. Due to the coupling effect of the scanning line 5002, the output power of the data line is reduced. When the four-level drive waveform is applied to the pixel unit in the FIG. 5, the electrical potential of the pixel is increase or reduced by the coupling effect of the scanning line 5002. Such coupling reduces the electrical potential output range of the data line to reduce the power. The left part of FIG. 12 illustrates the corresponding waveform in the even frame. The right part of FIG. 12 illustrates the corresponding waveform in the odd frame.

During the time segment T1 of the even frame, the scanning line 5006 is selected. The electric potential of the scanning line 5002 is pulled down to the electric potential V2. At this time, a negative polarity data is transferred in the data line 5008. The electric potentials of the gate electrodes of the thin film transistors 5010 and 5012 are increased to V1 to turn on the thin film transistors 5010 and 5012. The data in the data line 5008 is transferred to the pixel electrode 5022 through the thin film transistor 5010. The data in the data line 5008 is transferred to the pixel electrode 5024 through the thin film transistor 5012. When the time segment T1 is almost over, the pixel electrodes 5022 and 5024 have the same electric potential. During the time segment T2, the electric potential on the scanning line 5006 is pulled down to the electric potential V4 to turn off the thin film transistor 5010 and 5012. At this moment, the electric potential on the scanning line 5002 is pulled down from the electric potential V2 to the electric potential V3.

On the other hand, the scanning line 5006 is coupled to the pixel electrode 5022 through the parasitical capacitor 5026. The scanning line 5006 is coupled to the pixel electrode 5024 through the parasitical capacitor 5028. Therefore, the electric potentials of the pixel electrodes 5022 and 5024 are affected by the electric potential variation (V1-V4) of the scanning line 5006 during the time segment T2.

Moreover, the scanning line 5002 is coupled to the pixel electrode 5022 through the storage capacitors 5014. The scanning line 5002 is coupled to the pixel electrode 5024 through the storage capacitors 5016. Therefore, the electric potential of the pixel electrodes 5022 and 5024 is also affected by the electric potential variation of the scanning line 5002. The electric potentials of the pixel electrodes 5022 and 5024 are separated by modifying the capacitance of the storage capacitors 5014 and 5016. The different electric potential value forms different Gamma curves to reach the Half-tone effect.

During the time segment T2, the electric potential variation of the pixel electrode 5024, ΔV(5024), is described in the following:

$$\Delta V(5024) = \left|\frac{C_{gs}(5028)}{C_T(5024)}(V1 - V4) + \frac{C_{st}(5016)}{C_T(5024)}(V2 - V3)\right|,$$

and $$C_T(5024)=C_{lc}(5020)+C_{st}(5016)+C_{gs}(5028)$$

The $C_T$(5024) is the total capacitance related to the pixel electrode 5024. The $C_{lc}$(5020) is the capacitance of the liquid crystal capacitor 5020. The $C_{st}$(5016) is the capacitance of the storage capacitor 5016. The $C_{gs}$(5028) is the capacitance of the parasitical capacitor 5028.

Moreover, the $$\frac{C_{st}(5016)}{C_T(5024)}(V2 - V3)$$

is the electric potential variation value of the pixel electrode 5024 because of the coupling effect from the scanning line 5002.

During the time segment T2, the electric potential variation of the pixel electrode 5022, ΔV(5022), is described in the following:

$$\Delta V(5022) = \frac{C_{gs}(5026)}{C_T(5022)}(V1 - V4) + \frac{C_{st}(5014)}{C_T(5022)}(V2 - V3),$$

and $$C_T(5022)=C_{lc}(5018)+C_{st}(5014)+C_{gs}(5026)$$

The $C_T$(5022) is the total capacitance related to the pixel electrode 5022. The $C_{lc}$(5018) is the capacitance of the liquid crystal capacitor 5018. The $C_{st}$(5014) is the capacitance of the storage capacitor 5014. The $C_{gs}$(5026) is the capacitance of the parasitical capacitor 5026.

Moreover, the $$\frac{C_{st}(5014)}{C_T(5022)}(V2-V3)$$

is the electric potential variation value of the pixel electrode 5022 because of the coupling effect from the scanning line 5002.

In the odd frame, positive polarity data is transferred in the data line 5008. Please refer to FIG. 12 and FIG. 5 together. During the time segment T3 of the odd frame, the drive waveform for driving the scanning line 5002 is pulled down to the electric potential V4. The drive waveform for driving the scanning line 5006 is pulled up to the electric potential V1 to turn on the thin film transistors 5010 and 5012. The data in the data line 5008 is transferred to the pixel electrode 5022 through the thin film transistor 5010. The data in the data line 5008 is transferred to the pixel electrode 5024 through the thin film transistor 5012. When the time segment T3 is almost over, the pixel electrodes 5022 and 5024 have the same electric potential.

During the time segment T4, the electric potential on the scanning line 5006 is pulled down to the electric potential V2 to turn off the thin film transistor 5010 and 5012. At this moment, the electric potential on the scanning line 5002 is pulled up from the electric potential V4 to the electric potential V3. The scanning line 5002 is coupled to the pixel electrode 5022 through the storage capacitor 5014. The scanning line 5002 is coupled to the pixel electrode 5024 through the storage capacitor 5016. Therefore, the electric potentials of the pixel electrodes 5022 and 5024 are affected by the electric potential variation (V3-V4) of the scanning line 5002. The electric potentials of the pixel electrodes 5022 and 5024 are separated by modifying the capacitance of the storage capacitors 5014 and 5016. The different electric potential value forms different Gamma curves to reach the Half-tone effect. The advantage of using the four level drive waveform is that the electrical potential output range of the data line is reduced to reduce the power.

During the time segment T4, the electric potential variation of the pixel electrode 5024, ΔV(5024), is described in the following:

$$\Delta V(5024)=\left|\frac{C_{gs}(5028)}{C_T(5024)}(V1-V2)-\frac{C_{st}(5016)}{C_T(5024)}(V3-V4)\right|,$$

and $$C_T(5024)=C_{lc}(5020)+C_{st}(5016)+C_{gs}(5028)$$

The $C_T$(5024) is the total capacitance related to the pixel electrode 5024. The $C_{lc}$(5020) is the capacitance of the liquid crystal capacitor 5020. The $C_{st}$(5016) is the capacitance of the storage capacitor 5016. The $C_{gs}$(5028) is the capacitance of the parasitical capacitor 5028.

During the time segment T4, the electric potential variation of the pixel electrode 5022, ΔV(5022), is described in the following:

$$\Delta V(5022)=\left|\frac{C_{gs}(5026)}{C_T(5022)}(V1-V2)-\frac{C_{st}(5014)}{C_T(5022)}(V3-V4)\right|,$$

and $$C_T(5022)=C_{lc}(5018)+C_{st}(5014)+C_{gs}(5026)$$

The $C_T$(5022) is the total capacitance related to the pixel electrode 5022. The $C_{lc}$(5018) is the capacitance of the liquid crystal capacitor 5018. The $C_{st}$(5014) is the capacitance of the storage capacitor 5014. The $C_{gs}$(5026) is the capacitance of the parasitical capacitor 5026.

The foregoing application of the drive waveform illustrated in FIG. 11 is based on the pixel unit 500 of the third embodiment in FIG. 5. However, it is noticed that the drive waveform illustrated in FIG. 11 also is used in the pixel unit 600 of the fourth embodiment in FIG. 6.

Figure 13:
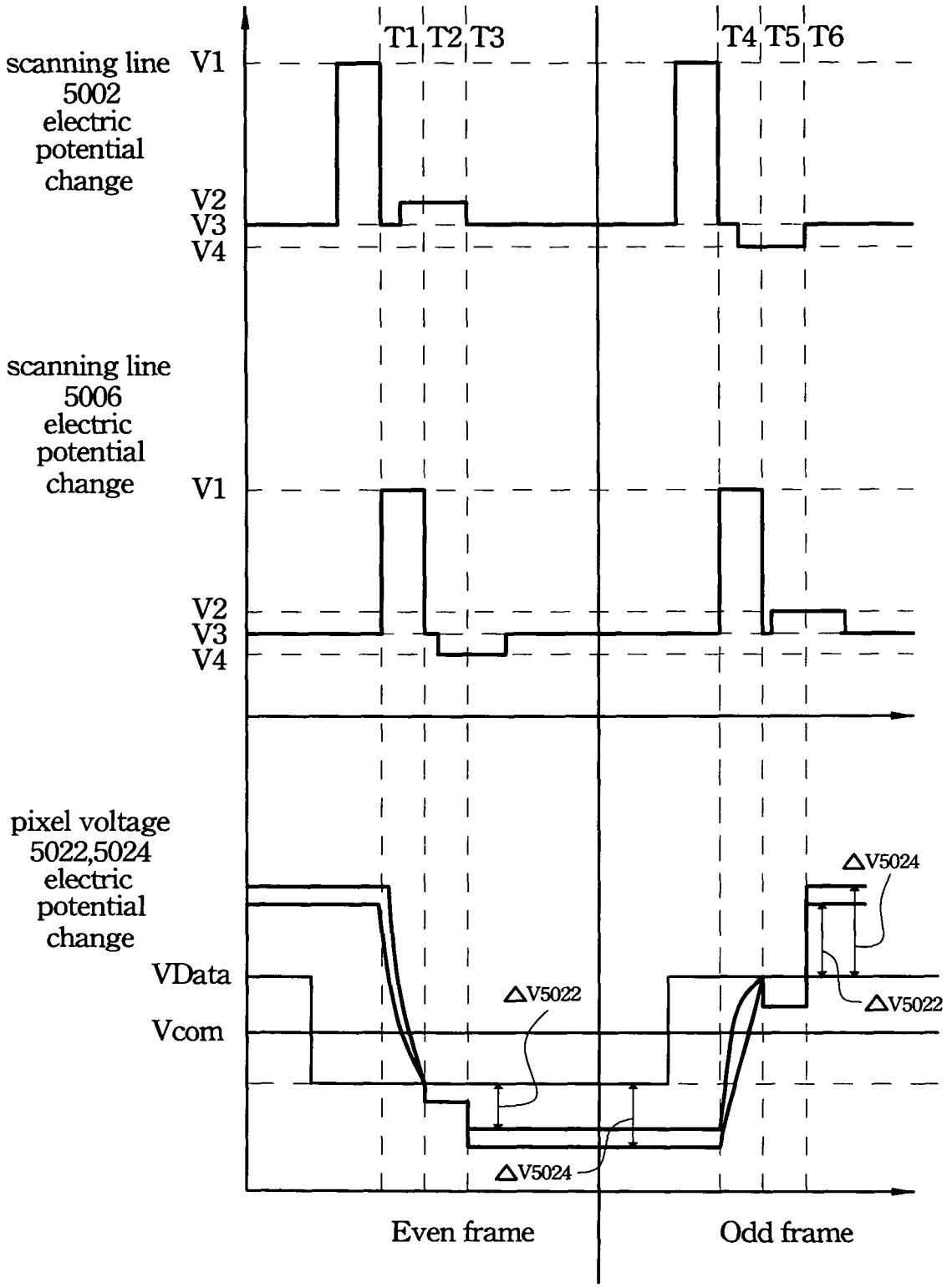
FIG. 13 illustrates the two steps four-level drive waveform and the electric potential change of pixel electrodes according to an embodiment of the present invention.

FIG. 13 illustrates the two-step four-level drive waveform and the electric potential change of pixel electrodes according to an embodiment of the present invention. Please refer to FIG. 13 and FIG. 5 together. In this embodiment, the drive waveform includes four electric potential, V1, V2, V3 and V4. The relationship among the four electric potential is V1>V2>V3>V4. In the two-step four-level drive waveform, the waveform transition is always generated by the electric potential V3 to the destination electric potential. Such transitions avoid the problems cause by data errors due to the time delay and non-uniform drive waveform. The left part of FIG. 13 illustrates the corresponding waveform in the even frame. The right part of FIG. 13 illustrates the corresponding waveform in the odd frame.

During the time segment T1 of the even frame, the electric potential of the scanning line 5002 is first pulled down to the electric potential V3, then pulled up to the electric potential V2. The electric potential of the scanning line 5006 is pulled up to the electric potential V1 to turn on the thin film transistors 5010 and 5012. The data in the data line 5008 is transferred to the pixel electrode 5022 through the thin film transistor 5010. The data in the data line 5008 is transferred to the pixel electrode 5024 through the thin film transistor 5012. When the time segment T1 is almost over, the pixel electrodes 5022 and 5024 have the same electric potential. During the time segment T2, the electric potential on the scanning line 5006 is first pulled down to the electric potential V3, then, pulled down to the electric potential V4 to turn off the thin film transistors 5010 and 5012.

On the other hand, the scanning line 5006 is coupled to the pixel electrodes 5022 and 5024 through the parasitical capacitors 5026 and 5028 respectively. Therefore, the electric potentials of the pixel electrodes 5022 and 5024 are affected by the electric potential variation (V1-V4) of the scanning line 5006 during the time segment T2. In this time segment T3, the electric potential of the scanning line 5002 is pulled down to the electric potential V3 from the electric potential V2.

The scanning line 5002 is coupled to the pixel electrode 5022 through the storage capacitors 5014. The scanning line 5002 is coupled to the pixel electrode 5024 through the storage capacitor 5016. Therefore, the electric potentials of the pixel electrodes 5022 and 5024 are affected by the electric potential variation (V2-V3) of the scanning line 5002. The electric potential variation (V2-V3) of the scanning line 5002 is coupled to the pixel electrodes 5022 and 5024 to increase the absolute value of the electric potential of the pixel electrodes 5022 and 5024. Such variation separates the electric potential value between the pixel electrodes 5022 and 5024. The different electric potential value between the pixel electrodes 5022 and 5024 forms different Gamma curves to reach the Half-tone effect.

During the time segment T3, the electric potential variation of the pixel electrode 5024, ΔV(5024), is described in the following:

$$\Delta V(5024) = \frac{C_{gs}(5028)}{C_T(5024)}(V1 - V4) + \frac{C_{st}(5016)}{C_T(5024)}(V2 - V3),$$

and $$C_T(5024)=C_{lc}(5020)+C_{st}(5016)+C_{gs}(5028)$$

The $C_T$(5024) is the total capacitance related to the pixel electrode 5024. The $C_{lc}$(5020) is the capacitance of the liquid crystal capacitor 5020. The $C_{st}$(5016) is the capacitance of the storage capacitor 5016. The $C_{gs}$(5028) is the capacitance of the parasitical capacitor 5028.

Moreover, the $$\frac{C_{st}(5016)}{C_T(5024)}(V2 - V3)$$

is the electric potential variation value of the pixel electrode 5024 because of the coupling effect from the scanning line 5002.

During the time segment T2, the electric potential variation of the pixel electrode 5022, ΔV(5022), is described in the following:

$$\Delta V(5022) = \frac{C_{gs}(5026)}{C_T(5022)}(V1 - V4) + \frac{C_{st}(5014)}{C_T(5022)}(V2 - V3),$$

and $$C_T(5022)=C_{lc}(5018)+C_{st}(5014)+C_{gs}(5026)$$

The $C_T$(5022) is the total capacitance related to the pixel electrode 5022. The $C_{lc}$(5018) is the capacitance of the liquid crystal capacitor 5018. The $C_{st}$(5014) is the capacitance of the storage capacitor 5014. The $C_{gs}$(5026) is the capacitance of the parasitical capacitor 5026.

Moreover, the $$\frac{C_{st}(5014)}{C_T(5022)}(V2 - V3)$$

is the electric potential variation value of the pixel electrode 5022 because of the coupling effect from the scanning line 5002.

In the odd frame of FIG. 13, positive polarity data is transferred in the data line 5008. Please refer to FIG. 13 and FIG. 5 together. During the time segment T4 of the odd frame, the drive waveform for driving the scanning line 5006 is pulled up to the electric potential V1 to turn on the thin film transistors 5010 and 5012. The electric potential of the scanning line 5002 is fist pulled down to the electric potential V3, then, pulled down to the electric potential V4. During the time segment T5 of the odd frame, the drive waveform for driving the scanning line 5006 is pulled down to the electric potential V3, then, pulled up to the electric potential V2 to turn off the thin film transistor 5010 and 5012. At this time, an electric potential variation (V1-V2) is generated on the scanning line 506. The pixel electrode 5022 is isolated to the pixel electrode 5024. During the time segment T6, the drive waveform for driving the scanning line 5002 is pulled up to the electric potential V3 to generate an electric potential variation (V3-V4). The electric potential variation (V3-V4) of the scanning line 5002 is coupled to the pixel electrodes 5022 and 5024 to increase the absolute value of the electric potential variation of the pixel electrodes 5022 and 5024. Such variation separates the electric potential value between the pixel electrodes 5022 and 5024. The different electric potential value between the pixel electrodes 5022 and 5024 forms different Gamma curves to reach the Half-tone effect. The advantage of using a four-level drive waveform is that more parameters are used to change the electric potential of the pixel electrodes 5022 and 5024. Therefore, more electric potential difference variation between the pixel electrodes 5022 and 5024 is obtained to improve the color performance of the liquid crystal display.

During the time segment T6, the electric potential variation of the pixel electrode 5024, ΔV(5024), is described in the following:

$$\Delta V(5024) = \left|\frac{C_{gs}(5028)}{C_T(5024)}(V1 - V2) - \frac{C_{st}(5016)}{C_T(5024)}(V3 - V4)\right|,$$

and $$C_T(5024)=C_{lc}(5020)+C_{st}(5016)+C_{gs}(5028)$$

The $C_T$(5024) is the total capacitance related to the pixel electrode 5024. The $C_{lc}$(5020) is the capacitance of the liquid crystal capacitor 5020. The $C_{st}$(5016) is the capacitance of the storage capacitor 5016. The $C_{gs}$(5028) is the capacitance of the parasitical capacitor 5028.

Moreover, the $$\frac{C_{st}(5016)}{C_T(5024)}(V3 - V4)$$

is the electric potential variation value of the pixel electrode 5024 because of the coupling effect from the scanning line 5002.

The electric potential variation of the pixel electrode 5022, ΔV(5022), is described in the following:

$$\Delta V(5022) = \left|\frac{C_{gs}(5026)}{C_T(5022)}(V1 - V2) - \frac{C_{st}(5014)}{C_T(5022)}(V3 - V4)\right|,$$

and $$C_T(5022)=C_{lc}(5018)+C_{st}(5014)+C_{gs}(5026)$$

The $C_T$(5022) is the total capacitance related to the pixel electrode 5022. The $C_{lc}$(5018) is the capacitance of the liquid crystal capacitor 5018. The $C_{st}$(5014) is the capacitance of the storage capacitor 5014. The $C_{gs}$(5026) is the capacitance of the parasitical capacitor 5026.

Moreover, the $$\frac{C_{st}(5014)}{C_T(5022)}(V3 - V4)$$

is the electric potential variation value of the pixel electrode 5022 because of the coupling effect from the scanning line 5002.

The foregoing application of the drive waveform illustrated in FIG. 12 is based on the pixel unit 500 of the third embodiment in FIG. 5. However, it is noticed that the drive waveform illustrated in FIG. 12 also be used in the pixel unit 600 of the fourth embodiment in FIG. 6.

Figure 14:
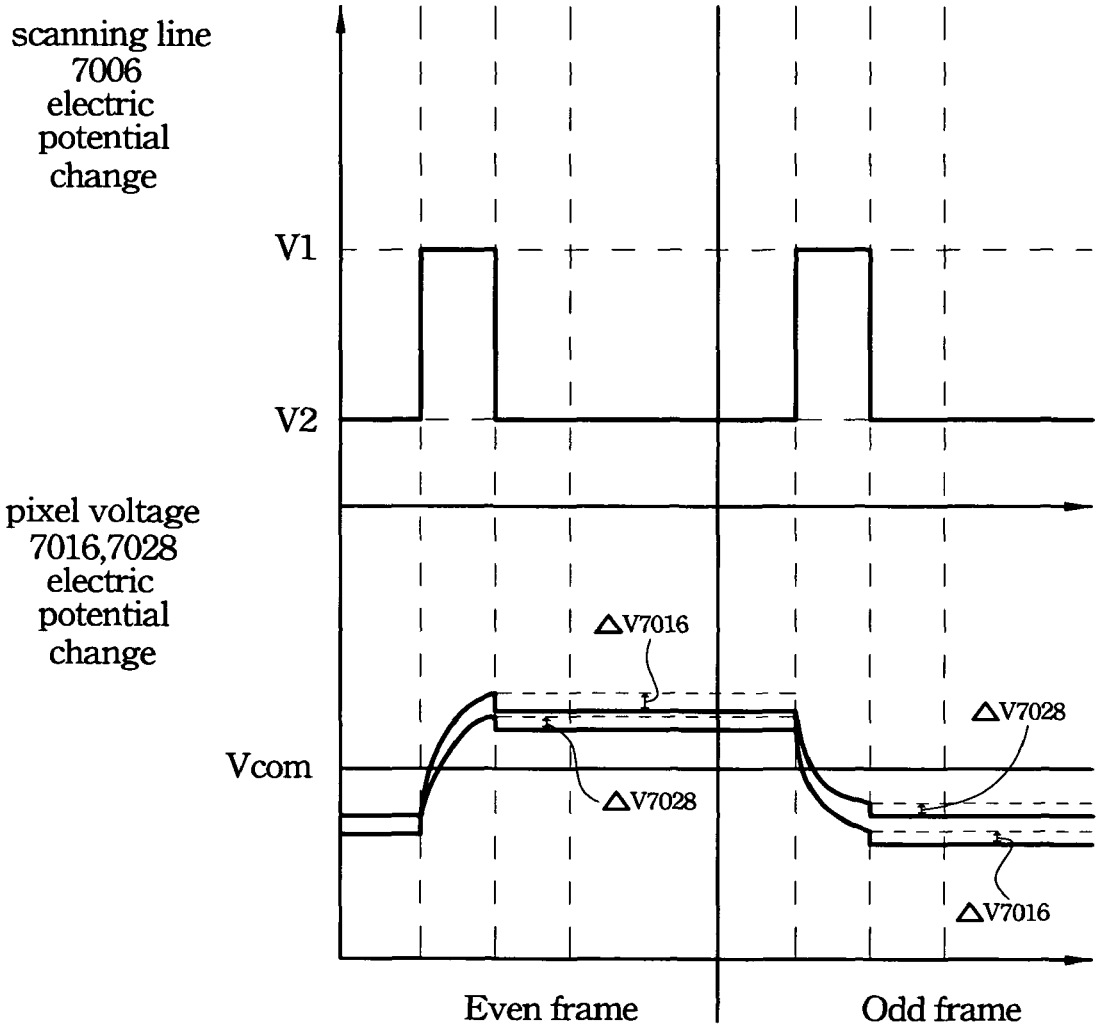
FIG. 14 illustrates the one step two-level drive waveform and the electric potential change of pixel electrodes according to an embodiment of the present invention.

FIG. 14 illustrates the two-level drive waveform and the electric potential change of pixel electrodes according to an embodiment of the present invention. Please refer to FIG. 14 and FIG. 7 together. In this embodiment, the drive waveform includes two electric potentials, V1 and V2. The relationship between the two electric potentials is V1>V2. As described in the foregoing, the two thin film transistors 7010 and 7022 have different design specifications. Based on the different design specifications, the two thin film transistors 7010 and 7022 have different charge capacity. Therefore, the electric potential of the pixel electrodes 7016 and 7018 can be separated. The left part of FIG. 14 illustrates the corresponding waveform in the even frame. The right part of FIG. 14 illustrates the corresponding waveform in the odd frame.

During the time segment T1 of the even frame. The electric potential of the scanning line 7006 is pulled up to the electric potential V1 to turn on the thin film transistors 7010 and 7022. The data in the data line 7008 is transferred to the pixel electrode 7028 through the thin film transistor 7022 and the thin film transistor 7010. The data in the data line 7008 is transferred to the pixel electrode 7016 through the thin film transistor 7010. Because of the different charge capacity of the thin film transistors 7010 and 7022, the electric potentials of the pixel electrodes 7016 and 7028 are different. During the time segment T2, the electric potential on the scanning line 7006 is pulled down to the electric potential V2 to turn off the thin film transistor 7010 and 7022. Therefore, the pixel electrode 7016 is isolated to the pixel electrode 7028.

In the odd frame of FIG. 14, positive polarity data is transferred in the data line 7008. Please refer to FIG. 14 and FIG. 7 together. During the time segment T3, the drive waveform for driving the scanning line 7006 is pulled up to the electric potential V1 to turn on the thin film transistors 7010 and 7022. The data in the data line 7008 is transferred to the pixel electrode 7028 through the thin film transistor 7022. The data in the data line 7008 is transferred to the pixel electrode 7016 through the thin film transistor 7010. Because of the different charge capacity of the thin film transistors 7010 and 7022, the electric potentials of the pixel electrodes 7016 and 7028 are different. During the time segment T4, the electric potential on the scanning line 7006 is pulled down to the electric potential V2 to turn off the thin film transistor 7010 and 7022. Therefore, the pixel electrode 7016 is isolated to the pixel electrode 7028.

Accordingly, a pixel unit in the present invention is divided into two sub-pixels. Each sub-pixel includes a thin film transistor, a liquid crystal capacitor and a storage capacitor. The two sub-pixels generate different pixel voltage to compensate to each other to release the color shift phenomenon.

As is understood by a person skilled in the art, the foregoing descriptions of the preferred embodiment of the present invention are an illustration of the present invention rather than a limitation thereof. Various modifications and similar arrangements are included within the spirit and scope of the appended claims. The scope of the claims should be accorded to the broadest interpretation so as to encompass all such modifications and similar structures. While a preferred embodiment of the invention has been illustrated and described, it will be appreciated that various changes can be made therein without departing from the spirit and scope of the invention.

What is claimed is:

1. A liquid crystal display driving method for driving a liquid crystal display, wherein the liquid crystal display comprises a substrate; a first scanning line and a second scanning line arranged on the substrate; a data line and a pixel unit arranged on the substrate, wherein the pixel unit includes a first sub-pixel and a second sub-pixel; a first thin film transistor located in the first sub-pixel, wherein the first thin film transistor includes a first gate electrode coupling with the first scanning line, a first source electrode and a first drain electrode coupling with the data line; and a second thin film transistor located in the second sub-pixel, wherein the second thin film transistor includes a second gate electrode coupling with the first scanning line, a second source electrode and a second drain electrode coupling with the data line; wherein the first source electrode is coupled to a first voltage source through a first capacitor, the second source electrode is coupled to a second voltage source through a second capacitor and the first drain electrode is coupled to the data line, the method comprising:

providing a high level electric potential to a first scanning line for writing a data signal transferred in a data line to a first sub-pixel electrode and a second sub-pixel electrode; and providing a low level electric potential to the first scanning line for isolating the first sub-pixel electrode and the second sub-pixel electrode from the data line;

transitioning the electric potential between the high level electric potential and the low level electric potential;

generating a coupling electric potential to a second scanning line to the first sub-pixel electrode and the second sub-pixel electrode, wherein the second scanning line is adjacent to the first scanning line.

2. The liquid crystal display driving method of claim 1, wherein the liquid crystal display driving method is a three level liquid crystal display driving method including a first electric potential, a second electric potential and a third electric potential, wherein the first electric potential is larger than the second electric potential, and the second electric potential is larger than the third electric potential.

3. The liquid crystal display driving method of claim 2, wherein the high level electric potential is the first electric potential, the low level electric potential is the second electric potential, and the coupling electric potential is generated when the third electric potential transited to the second electric potential.

* * * * *